US011519633B1

(12) United States Patent
Carpenter et al.

(10) Patent No.: US 11,519,633 B1
(45) Date of Patent: Dec. 6, 2022

(54) RUGGEDIZED ENVIRONMENTAL CONTROL UNIT

(71) Applicant: Mainstream Engineering Corporation, Rockledge, FL (US)

(72) Inventors: Andrew L. Carpenter, Rockledge, FL (US); Joseph A. Holtz, Rockledge, FL (US); Daniel L. Murphy, Melbourne, FL (US); William J. Harrington, Rockledge, FL (US); Gregory S. Cole, Melbourne, FL (US); Robert P. Scaringe, Rockledge, FL (US)

(73) Assignee: Mainstream Engineering Corporation, Rockledge, FL (US)

( * ) Notice: Subject to any disclaimer, the term of this patent is extended or adjusted under 35 U.S.C. 154(b) by 8 days.

(21) Appl. No.: 17/350,160

(22) Filed: Jun. 17, 2021

(51) Int. Cl.

| | |
|---|---|
| ***F24F 13/20*** | (2006.01) |
| ***F24F 1/029*** | (2019.01) |
| ***F24F 13/22*** | (2006.01) |
| ***F24F 1/031*** | (2019.01) |

(52) U.S. Cl.
CPC ..... *F24F 13/20* (2013.01); *F24F 1/029* (2019.02); *F24F 1/031* (2019.02); *F24F 13/224* (2013.01); *F24F 2013/205* (2013.01); *F24F 2013/207* (2013.01)

(58) Field of Classification Search
CPC .... F24F 13/20; F24F 13/224; F24F 2013/205; F24F 2013/207; F24F 1/029; F24F 1/031; F24F 1/04; F24F 2221/52; B29C 41/04; B29K 2101/12; B60H 1/00364
See application file for complete search history.

(56) References Cited

U.S. PATENT DOCUMENTS

| | | | | |
|---|---|---|---|---|
| 6,151,906 | A * | 11/2000 | da Silva | F24F 1/027 62/279 |
| 6,276,156 | B1 * | 8/2001 | da Silva | F24F 13/20 62/262 |
| 9,370,882 | B2 * | 6/2016 | Giddons | B29C 41/04 |
| 2009/0139245 | A1 * | 6/2009 | Blackway | F25B 21/02 62/515 |
| 2011/0120167 | A1 * | 5/2011 | Lingrey | F24F 13/20 62/507 |
| 2014/0150488 | A1 * | 6/2014 | Black | F24F 3/14 29/890.035 |

FOREIGN PATENT DOCUMENTS

JP 2009138950 A * 6/2009

* cited by examiner

*Primary Examiner* — Edelmira Bosques
*Assistant Examiner* — Michael James Giordano
(74) *Attorney, Agent, or Firm* — Michael W. O'Neill, Esq.

(57) ABSTRACT

The present disclosure is directed to implementation of an environmental control unit using rotomolded techniques to fabricate the structures of the unit instead of the standard conventional sheet metal, extruded, forged, and punched parts. Such implementations will provide a lighter weight and more durable mechanical configuration that will also simplify inspection, simplify assembly/disassembly, and reduce fabrication costs. Implementations incorporate rotationally-molded interlocking structures to contain and attach the critical items of the ECU's mechanical components including the compressor, and the indoor and outdoor coils, as well as the fan and blower motor assembly. In one implementation, the rotomolded structure is strengthened and insulated (thermally and acoustically) by filling the interior void of the rotationally molded structure with a closed-cell foam.

17 Claims, 20 Drawing Sheets

RUGGEDIZED ENVIRONMENTAL CONTROL UNIT

BACKGROUND

The present disclosure provides for the reduction of the cost of manufacturing an environmental control unit (ECU), simplifies the inspection and servicing of the ECU, reduces the weight, and increases the ruggedness of the ECU. Particularly, the present disclosure is concerned with replacing conventional sheet metal, extruded, forged, and punched parts with a lighter weight and more durable mechanical configuration that will also simplify inspection, simplify assembly/disassembly, and reduce fabrication costs. Furthermore, the present disclosure contemplates the fabrication of the ECU utilizing a rotomolding process of manufacturing and provides a means for filling the hollow rotomolded structural components with a substance to provide a dampening of vibration and reduction of acoustical noise.

Implementations of the ECU, also referred to in the professional trades as an air conditioner or heat pump for cooling/heating and/or dehumidifying an interior space, such as a building interior or interior of a shelter or tent for example are disclosed herein. The improvements to legacy design includes simplified manufacturing, simplified inspection and servicing, reduced noise and vibration, reduced weight, and increased ruggedness of the unit. These benefits are achieved by incorporating rotationally molded interlocking structures to contain and attach the critical items of the ECU's mechanical components including the compressor and the indoor and outdoor coils, as well as the fan and blower motor assembly. In one implementation, the rotomolded structure is strengthened and insulated (thermal and acoustic) by filling the interior void of the rotationally molded structure with a closed-cell or open-cell foam. In an alternate implementation, to provide strength while also providing anchoring weight, the interior of the rotomolded base structure could alternatively be filled with water, sand, or other dense fluid or granular material, to provide ballast and strength, and this substance can be drained if the unit is to be moved.

Rotational molding or rotomolding, as it is referred to in the trade, is a well-known method to form hollow structures. As understood in the trade, rotational molding is a molding process that involves a heated hollow mold which is filled with a charge or shot weight of material. The mold is then slowly rotated, causing the softened material to disperse and coat the walls of the mold.

The following prior art appears material to the invention described herein.

U.S. Pat. No. 9,370,882 B2 to Giddons et al. discloses a cost effective and efficient air circulation system for a rotomolded vehicle body. According to the disclosure, the principal object of the invention is to provide a cost effective and efficient air circulation system. The inventors discuss creating an air flow pathway by the rotomolding process to generate a cavity in the wall of the body of the vehicle for cooling. In this disclosure, the inventors are seeking to use a portion of the hollow space formed by rotomolding to create air distribution ductwork. From col. 5, ll. 1-6, the inventors have realized that the rotomolding sections can include foam layers in the cavity formed by the inner and outer solid plastic skins, however they intentionally formed such foam filled volumes to "leave a continuous air filled cavity within and throughout the body walls." Unlike this approach, our preferred embodiment uses a completely foam filled core, that can be bonded to the interior molded surfaces to increase the stiffness, strength, and damping characteristics of the rotomolded component.

U.S. Pat. No. 9,150,295 B2 to West et al. discloses a modular personal watercraft where the modular components are fabricated by (col. 3, ll. 66-67 and col. 4, l. 1) blow molding, injection molding, and rotomolding. The inventors do highlight the cost savings of using molding processes and realized that (col. 2, ll. 60-62) the individual components could be connected by "interlocking channels and/or dovetail joints." In spite of this being a boat, no mention of filling the interior void of the rotomolded parts with a closed-cell foam are discussed for either flotation or structural benefits.

U.S. Pat. No. 9,526,332 B1 to Feinstein et al. describes a system of modular components used to build structures that are easily assembled and disassembled. This modular system can be "partially or fully constructed at a factory by rotomolding" (col 2, ll. 55-56). Likewise U.S. Pat. No. 6,149,228 to O'Neill et al. discloses a Modular Operator Enclosure assembled from modular components and U.S. Pat. No. 10,357,109 B2 to Nose discloses the manufacture of upholstered modular furniture formed by a plurality of modular components substantially composed of a polymeric material.

There is also prior art referring to methods to increase the structural strength of molded parts. U.S. Pat. No. 10,252,450 B2 to Zhang et al. discloses a reinforced thermoplastic product that may include a main body and a fabric reinforcing sheet that is disposed within a wall of the main body. Alternatively, U.S. Pat. No. 10,207,606 B2 to Roberts discloses an in-situ molded foam core structural plastic article having an outer shell with an interior cavity filled with expandable polymer beads which when expanded substantially fill the interior cavity forming a thermal bond with the shell. The bead and shell are of a similar plastic composition, allowing a thermal bond to be formed by heating. In our configuration, the interior fill material is not comprised of beads but instead an expanding open or closed-cell foam, which will more completely fill the interior without any void space and can bond to the mold material as it cures. The foam is of course not the same material as the external molded material.

While it is clear that the prior art understood that the use of molded plastic parts could reduce manufacturing costs and reduce weight, it is also clear that the additional benefits of using interlocking foam filled rotomolded parts to reduce vibration, reduce acoustical noise and provide damping of the structure was never realized. Likewise, the applicability of interlocking rotomolded parts for the manufacture of ruggedized ECUs (RECUs) has not been contemplated by the prior art. Finally, rotomolding allows depressions, indentations, or position locating surface features to be easily accommodated into the mold, making the rapid and failsafe (only fits one way due to the depression, indentation, or surface feature) location and positioning of components being assembled onto the rotomolded part. While the use of threaded inserts, to accept bolted parts and dovetailed attachment means (or the like) are used commonly, these attachment means can be used along with the parts locating features molded into the part, to make assembly of components onto the rotomolded part fast and failsafe.

For the foregoing reasons, there is a need for an improved ECU design that incorporates the benefits of rotomolding to reduce the cost of manufacturing, improve the ruggedness of the design, simplify maintenance and repair, and reduce vibration and noise when the ECU is operating. Reducing vibration will also lower the fatigue on refrigerant plumbing assemblies, thereby increasing reliability and life.

SUMMARY

The most basic implementation of the disclosure provides for a rotomolded base structure for a vapor compression system that can run in both cooling mode (air conditioning) and heating mode (as a heat pump), which has threaded inserts to allow direct bolting of certain components, e.g., the compressor, and outdoor coil, fan motor, and other components where the base structure has been formed, shaped, and contoured to allow portions of the compressor, indoor and outdoor coils, fan motor, and other components to be recessed into the base structure so as to provide additional structural support and facilitate correct and rapid location of these components. The condensate drain pans, which is used to capture condensate dripping from the indoor and outdoor coils, can be integrated directly into the rotomolded base structure along with holes to channel the condensate out of the ECU. The top structure has also been formed, shaped, and contoured to allow the components to be encompassed by the top structure.

The rotomolded ECU implementations provided by this disclosure contain a partition that that separates the indoor and outdoor sections of the ECU. This partition can be also filled with expanding foam (open or closed cell) to provide thermal insulation between the typically cooler indoor section and the warmer outdoor section. It should be noted that the reverse occurs in cold environments, i.e., warmer indoor section and cooler outdoor section. In the present disclosure, wherever the foam is used to fill the void in the rotomolded part, this foam also increases the structural rigidity while also providing vibration and noise dampening characteristics to the molded part. This is ideal because, in the case of the partition, the partition can now be used to partially and effectively support the double-ended fan motor where the shaft of the motor extends into both the indoor and outdoor sides of the ECU, allowing this single motor to drive both the outdoor fan and indoor blower (the term blower can also referred to as a fan). Since the motor driving both the indoor and outdoor fan blades is supported in part by the partition and all other vapor compression components have been located on, or supported or secured, by base structure, this means the entire vapor compression fluid and electrical circuit has been completely installed and can be connected, without the need of the top structure, thereby making assembly, inspection and performance testing simplified, due to the accessibility to the components when the top structure is removed. In one implementation, the top structure can contain recesses or slots or protrusions to accommodate the compressor, the indoor coil, and outdoor coil, thereby providing additional strength to hold the mechanical and electrical components.

In one implementation, a housing for an environmental control unit is disclosed having a rotomolded hollow base structure having a base bottom side, a base outdoor coil side extending from the base bottom side, a base control panel side extending from the base bottom side, a base return side extending from the base bottom side, a base supply side extending from the base bottom side, and a base partition extending from the base bottom side and ending in a first-half of a joint and spanning between the base return side and base supply side; and a rotomolded hollow top structure having a top side, a top outdoor coil side extending from the top side, a top control panel side extending from the top side, a top return side extending from the top side, a top supply side extending from the top side, and a top partition extending from the top side and ending in a second-half of the joint and spanning between the top return side and top supply side.

In one implementation of the housing, when the top structure is placed on the base structure, the base partition and the top partition mate together at the joint and separate the housing into an indoor air chamber between a return side formed from the base return side and top return side coming together and a supply side formed from the base supply side and the top supply side coming together and separate outdoor air chamber between an outdoor coil side formed from the base outdoor coil side and the top outdoor coil side coming together and a control panel side formed from the base control panel side and the top control panel side coming together.

In one implementation, the indoor air chamber is a boxed-shaped plenum.

In one implementation, the indoor air chamber is a blower volute.

In one implementation, the housing has a second base partition extending from the base bottom side and ending in a first-half of a second joint and ending proximate the base outdoor coil side and a second top partition extending from the top side and ending in a second-half of the second joint and ending proximate the top outdoor coil side.

In one implementation, when the top structure is placed on the base structure, the second base partition and the second top partition join together at the second joint and form an outdoor coil plenum with a section of the base partition and a section of the top partition and a fan shroud between the section of the base partition and the section of the top partition and the second base partition and the second top partition.

In one implementation, the housing has at least one first projection extending from the base bottom side of the base structure and located proximate the base partition.

In one implementation, the housing has at least one second projection extending from the base bottom side of the base structure and located proximate the intersection of the base return side and the base control panel side.

In one implementation, the housing has a base indoor coil recess having a first base indoor coil recess edge and a second base indoor coil recess edge within the base return side and a base coil edge within the base partition and located opposite the first base coil recess edge.

In one implementation, the housing has a top coil recess having a first top coil recess edge and a second top coil recess edge within the top return side and a top coil edge within the top partition and located opposite the first top coil recess edge.

In one implementation, the housing has a top coil recess having a first top coil recess edge and a second top coil recess edge within the top return side and a top coil edge within the top partition and located opposite the first top coil recess edge.

In one implementation, the base coil recess and top coil recess are in alignment when the top structure is placed on the base structure.

In one implementation, the housing has a first condensate pan recess formed in the base bottom side and spanning between the base indoor coil recess and the base indoor coil edge and a condensate pan drain formed in the base bottom side and proximate the condensate pan recess.

In one implementation, the housing has a second condensate pan recess formed in the base bottom side and spanning along the outdoor coil side.

In one implementation, the base structure has a plurality of alignment projections and the top structure has a plurality of alignment recesses for aligning the top structure onto the base structure.

In one implementation, the housing has a plurality of latches to secure the top structure to the base structure.

In one implementation, the base structure and the top structure are filled with a foam material.

In one implementation, the base structure has a plurality of feet and a plurality of fork lift access points.

In one implementation, the top structure has a plurality of drain channels.

These and other features, aspects, and advantages of the present invention will become better understood with reference to the following description and appended claims.

BRIEF DESCRIPTION OF THE DRAWINGS

These and other features, aspects, and advantages of the present invention will become better understood with regard to the following description, appended claims, and accompanying drawings where:

DESCRIPTION

In the Summary above and the Description, and the claims below, and in the accompany drawings, reference is made to particular features (including method steps) of the invention. It is to be understood that the disclosure of the implementations and features in this specification includes all possible combinations of such particular implementations and features.

Figure 1:
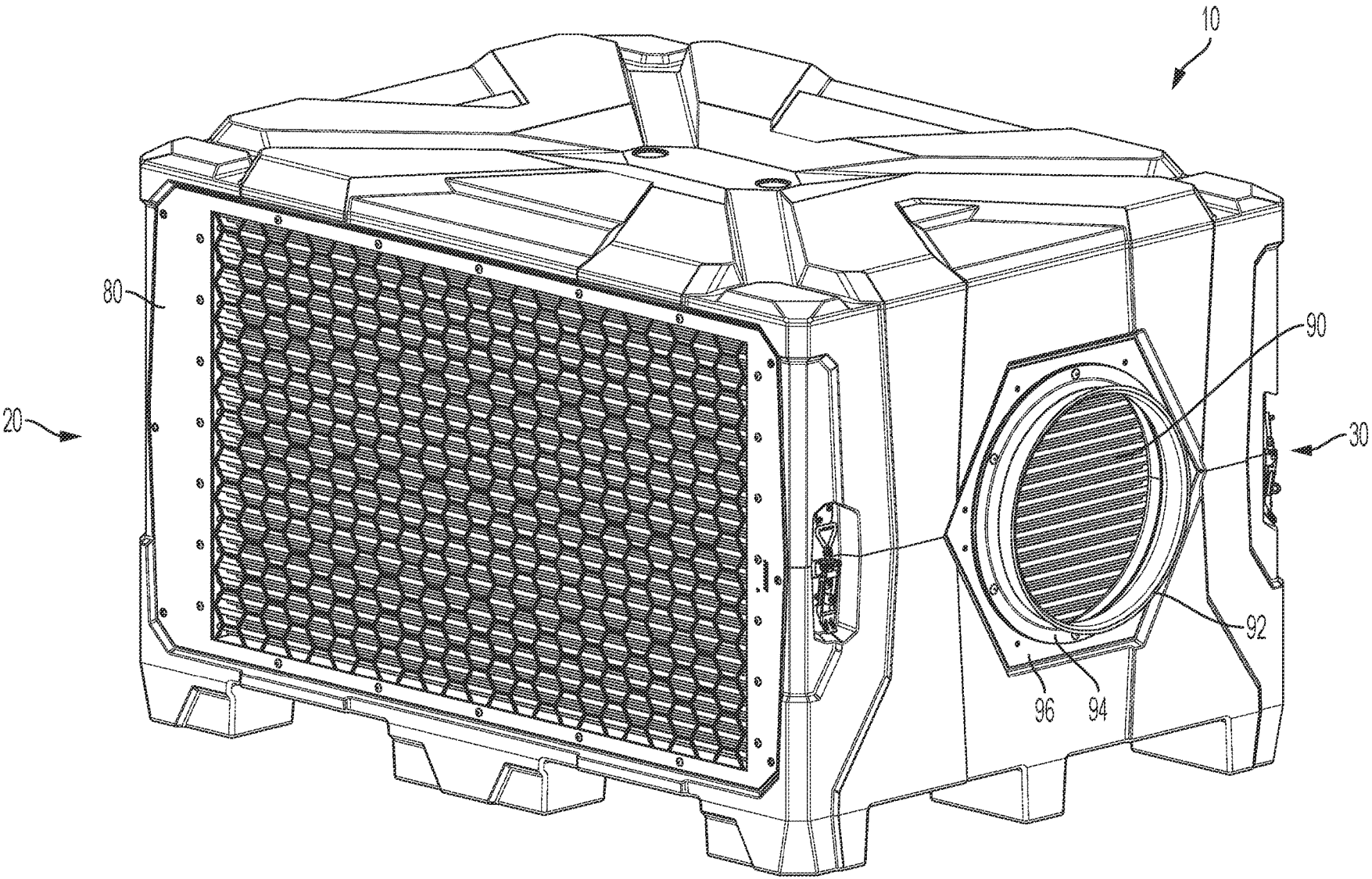
FIG. 1 shows an isometric view of one implementation of the ruggedized environmental control unit (RECU).
Figure 2:
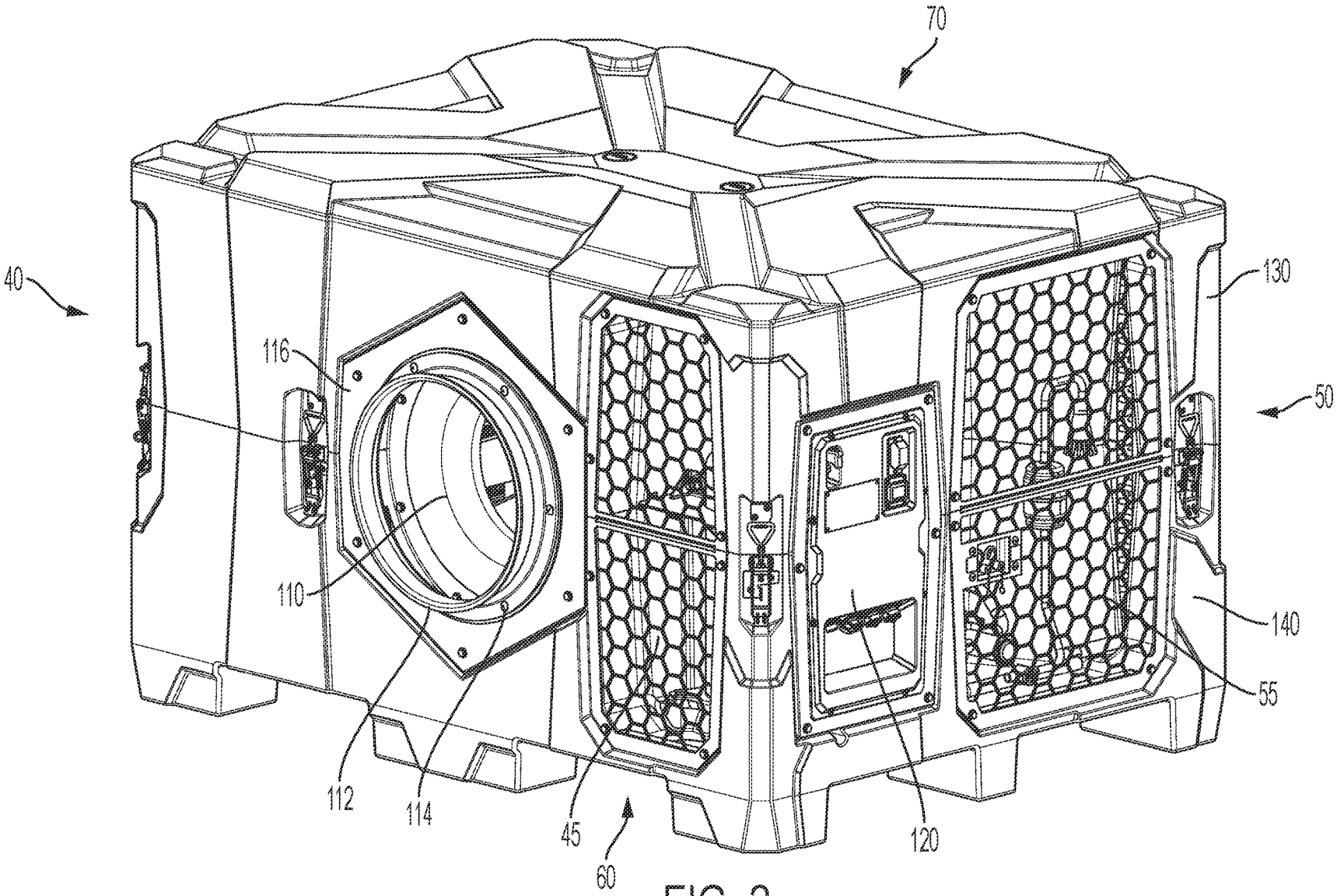
FIG. 2 shows an opposing isometric view of one implementation of the RECU.

In one implementation, the ruggedized environmental control unit housing (RECU) 10 is generally shaped as a cuboid having an outdoor coil side 20, supply side 30, return side 40, control panel side 50, bottom side 60, and top side 70. FIGS. 1 and 2.

In one implementation, an outdoor coil guard 80 is position in front of the outdoor coil 270 on the outdoor coil side 20. The outdoor coil guard 80 secures the outdoor coil 270 to the outdoor coil side 20 with fasteners. The outdoor coil guard protects the outdoor coil 270 from debris and collisions.

Figure 18:
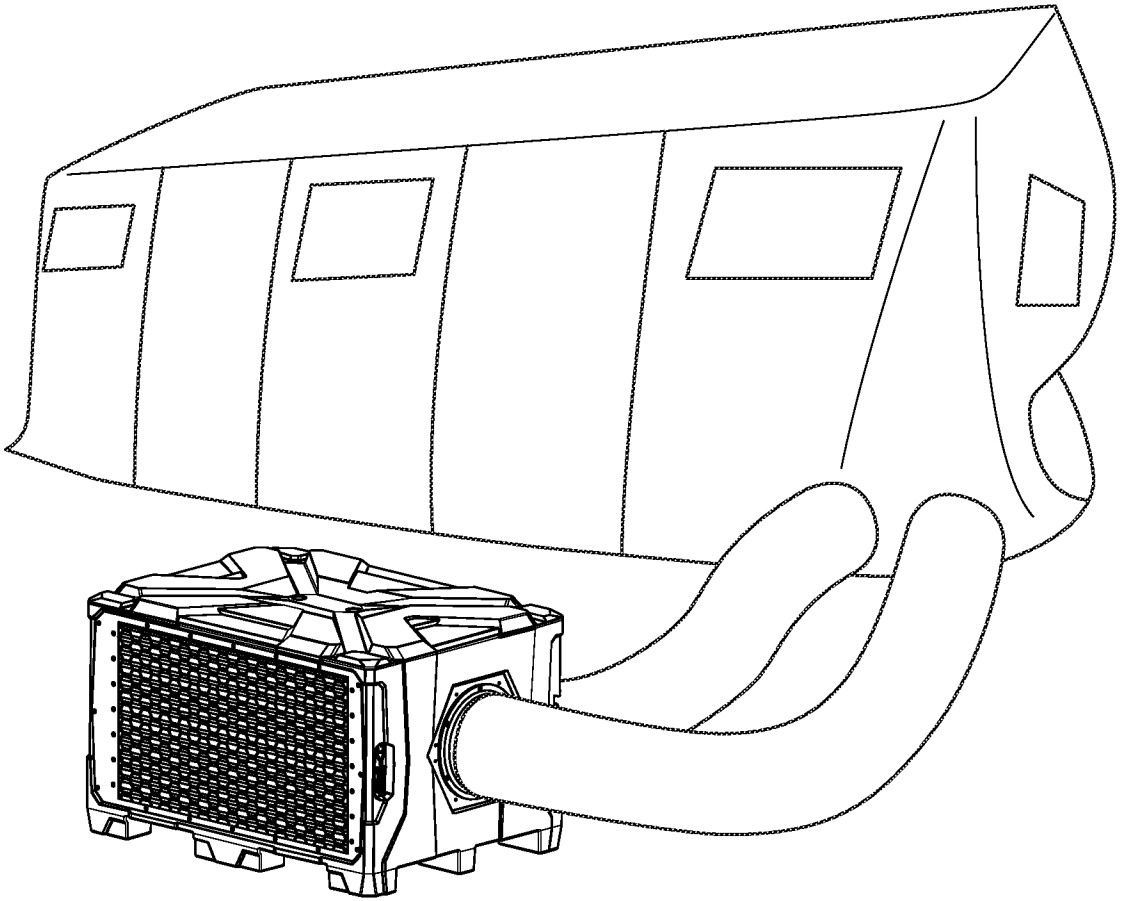
FIG. 18 show one implementation of the RECU providing environmental conditioning to a structure.

In one implementation, a supply outlet 90 is surrounded by a supply outlet flange 92 and the supply outlet flange 92 is used to connect a supply duct to the housing 10, such as shown in FIG. 18. In one implementation, the supply outlet flange 92 is made as one piece for the supply outlet flange plate section 94 and one piece for supply outlet side wall section 96. In one implementation, the supply outlet flange 92 can be one piece. In one implementation, the supply outlet flange 90 can be a multi-piece flange. In one implementation, a supply outlet gasket (not shown) can be placed between the supply side 30 and the supply outlet flange 90. In one implementation, the supply outlet gasket can be made from either one piece or multiple pieces to form a complete gasket and can be made from a flexible material or a rigid material.

In one implementation on the return side 40, a return inlet 110 is surrounded by a return inlet flange 112 and the return inlet flange 112 is used to connect a return duct to the housing 10, as shown in FIG. 18. In one implementation, the return inlet flange 112 is made as one piece for the return inlet plate section 114 and one piece for the return inlet side wall section 116. In one implementation, the return inlet flange 112 can be one piece. In one implementation, the return inlet flange 112 can be a multi-piece flange. In one implementation, a return inlet gasket (not shown) can be placed between the return side 40 and the return inlet flange 112. In one implementation, the return inlet gasket can be made from either one piece or multiple pieces to form a complete gasket and can be made from a flexible material or a rigid material.

In one implementation on the return side 40, a return side guard 45 is fastened to the return side 40 with fasteners. In one implementation, the return side guard 45 is a multiple piece grate. The return side guard 45 acts as a barrier to the compressor.

One implementation of a flexible material for both the supply outlet gasket and the return inlet gasket would be an adhesive backed EPDM foam. Other implementations, such as a neoprene cord, that do not include an adhesive backing are contemplated.

The control panel 120 is positioned on the control panel side 50. In one implementation on the control panel side 50, a control panel side guard 55 is fastened to the control panel side 50 with fasteners. In one implementation, the control panel side guard 55 is a multiple piece guard. The control panel side guard 55 acts as a barrier to the direct vapor compression tubing and components, such as the reversing valve, filter drier, and sight glass, positioned proximate the control panel side guard 55.

In one implementation, the RECU 10 is constructed from a top structure 130 and a base structure 140. Both the top structure and bottom structure are molded using a rotomold technique. This technique creates a hollow cavity within the surfaces of each structure and permits multiple surfaces features to be molded into the surfaces of the top structure 130 and base structure 140.

Figure 3:
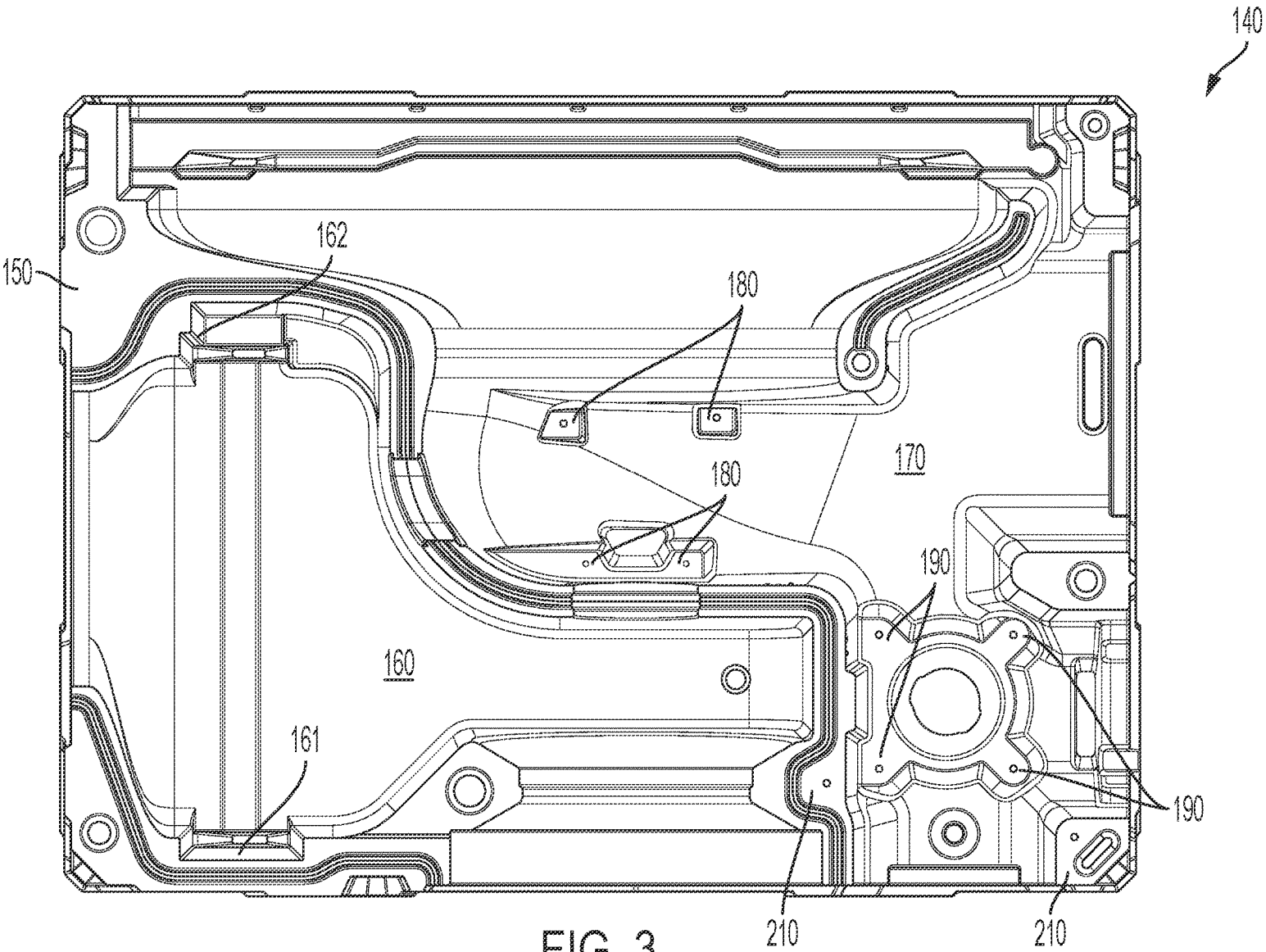
FIG. 3 shows a planar view of one implementation of the RECU's base structure.
Figure 4:
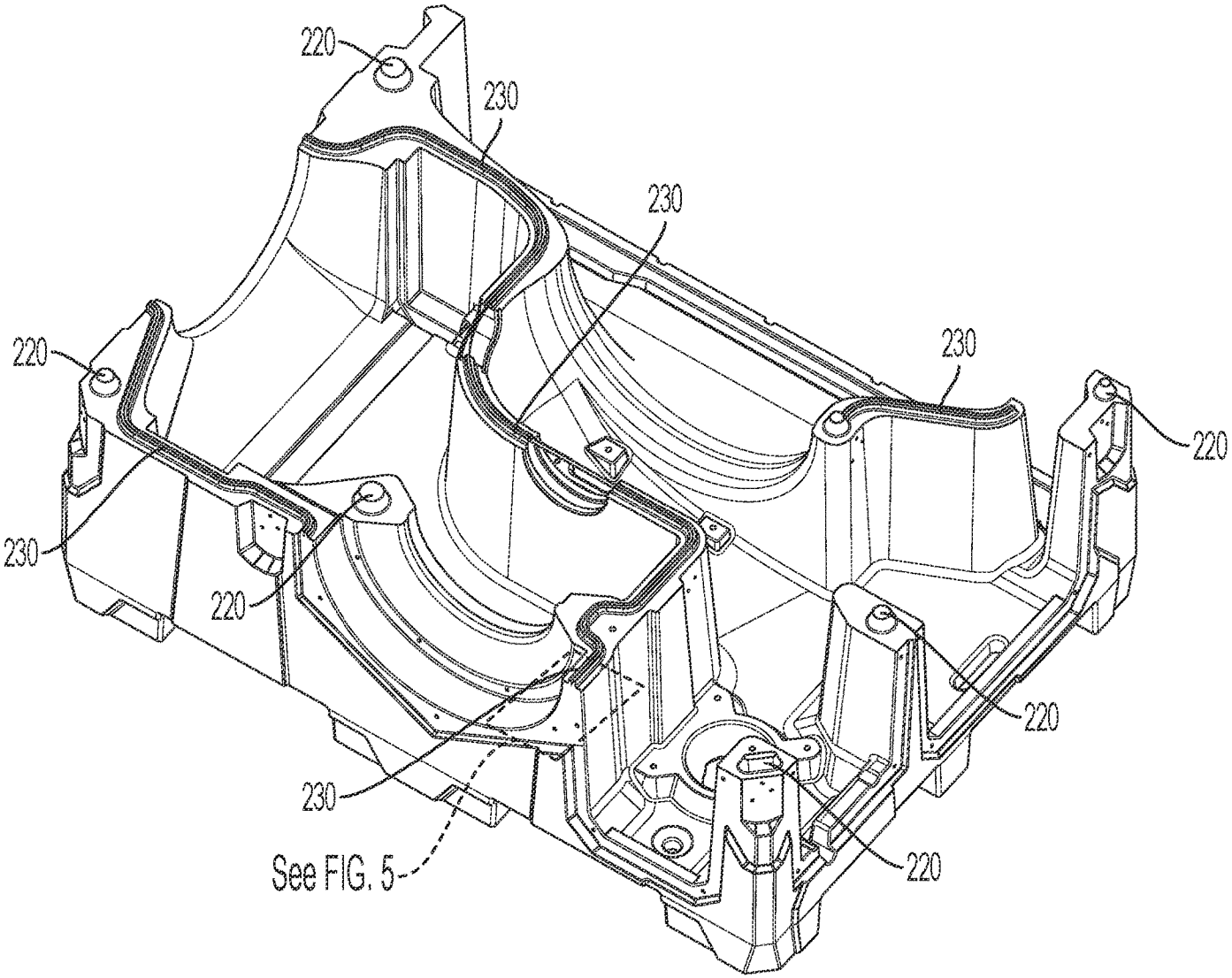
FIG. 4 shows an isometric view of one implementation of the RECU's base structure.
Figure 4A:
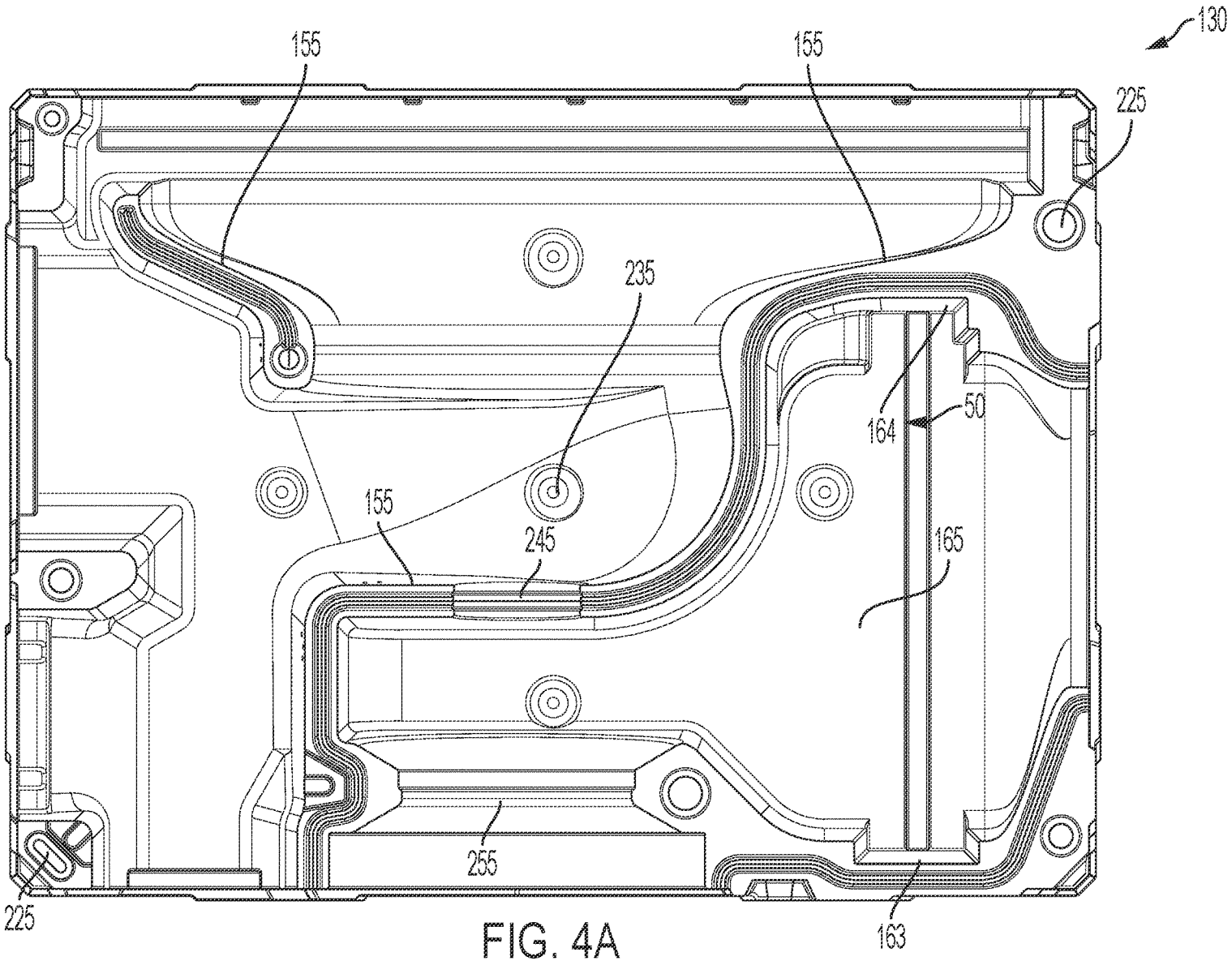
FIG. 4A shows a planar view of one implementation of the RECU's top structure.

In one implementation, a partition creates and separates indoor and outdoor air chambers within each top structure 130 or base structure 140. Both the top structure 130 and the base structure 140 have a formed partition. As illustrated in FIG. 3, for the base structure 140, partition 150 creates an indoor air chamber 160 and an outdoor air chamber 170. Further illustrated in FIG. 3 are indoor coil mount pockets 161 and 162 that are tapered to allow the indoor coil to pilot in to during installation and thus hold the coil in place without necessarily needing any additional fasteners. In FIG. 4A, what is shown is the top structure with its partition 155 that joins with the partition 150 in the base structure 140. With this design, outdoor air flows in from the outdoor side 20, through the outdoor chamber 170, and the outdoor air exhausts through both the control panel side 50 and the return side 40 via the grates 45 and 55. Also, indoor air that is intended to be conditioned by the RECU 10 flows into the RECU 10 from the return inlet 110 through the indoor air chamber 160, and the conditioned air is supplied to a location through the supply outlet 90. Further illustrated in FIG. 4A are indoor coil mount pockets 163 and 164 that are formed in top surface 125 of indoor air space and the pockets are tapered to allow the indoor coil to pilot in to during installation and thus hold the coil in place without necessarily needing any additional fasteners. Alignment features 225 assist in aligning the top structure 130 and base structure 140. Kiss off feature 235 connects two closely spaced walls to provide structural support and rigidity. Motor seal 245 is a half calm shell feature that will come together with its corresponding structure (not numbered) in the base structure 140 to seal around the motor 300. Blower inlet feature 255 is where the fan shroud ring or sleeve 365 would nest when such a ring or sleeve is used.

In one implementation, motor bracket mounting projections 180 are molded into the base structure 140 and partition 150 and are used to affix a motor mounting bracket (not shown) that the motor 300 would be attached thereto. Compressor mounting projections 190 are molded into the base structure 140. A motor mounting bracket (not shown) is affixed to the motor mounting points located in the mounting projections 180. The compressor 305 is directly affixed to the compressor mounting projections 190 by threaded inserts. In one implementation, compressor securing bracket locations 210 are located on the partition 150 and at the corner where the return side 40 and control panel side 50 intersect. The compressor securing bracket locations 210 are used to hold a compressor securing bracket (not shown). The top portion of compressor 305 would be secure to the compressor securing bracket with a U-shaped fastener mechanism (not shown).

Figure 5:
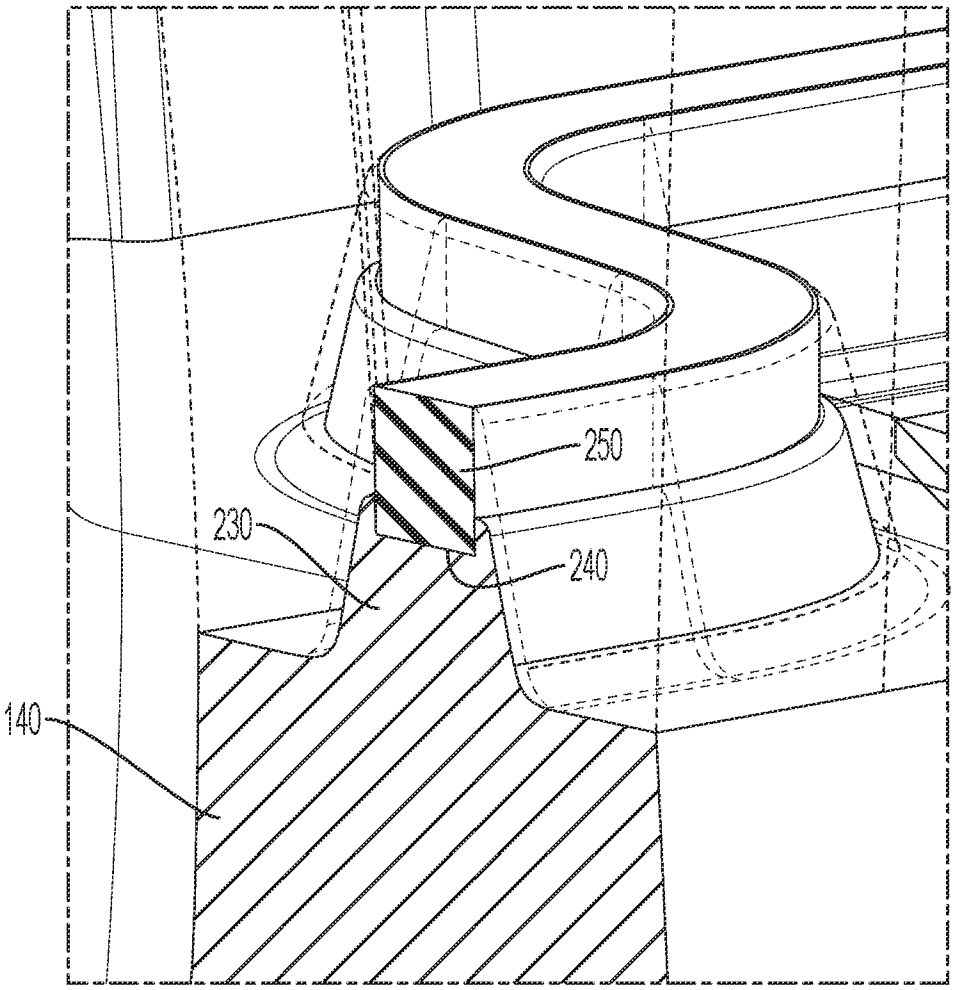
FIG. 5 shows an isometric view of one implementation of the connection of the RECU's base structure and top structure.

In one implementation of the base structure 140, protrusions 220 and ridge 230 are positioned around the base structure 140 and along the partition 150 and facilitate the alignment of top structure 130 onto the base structure 140. One implementation of the ridge 230 is shown in FIG. 5. The ridge 230 contains a channel 240 and a gasket 250 is inserted into the channel 240. In another implementation, the channel 240 is deleted and the gasket material is inserted into a top structure channel (shown in dash-line in FIG. 5) on the top structure 130 that follows the positioning of the ridge 230 and the rests on the ridge and when the top structure 130 and base structure 140 are placed together the gasket 250 seals the created joint, e.g., a tongue and groove joint.

Figure 6:
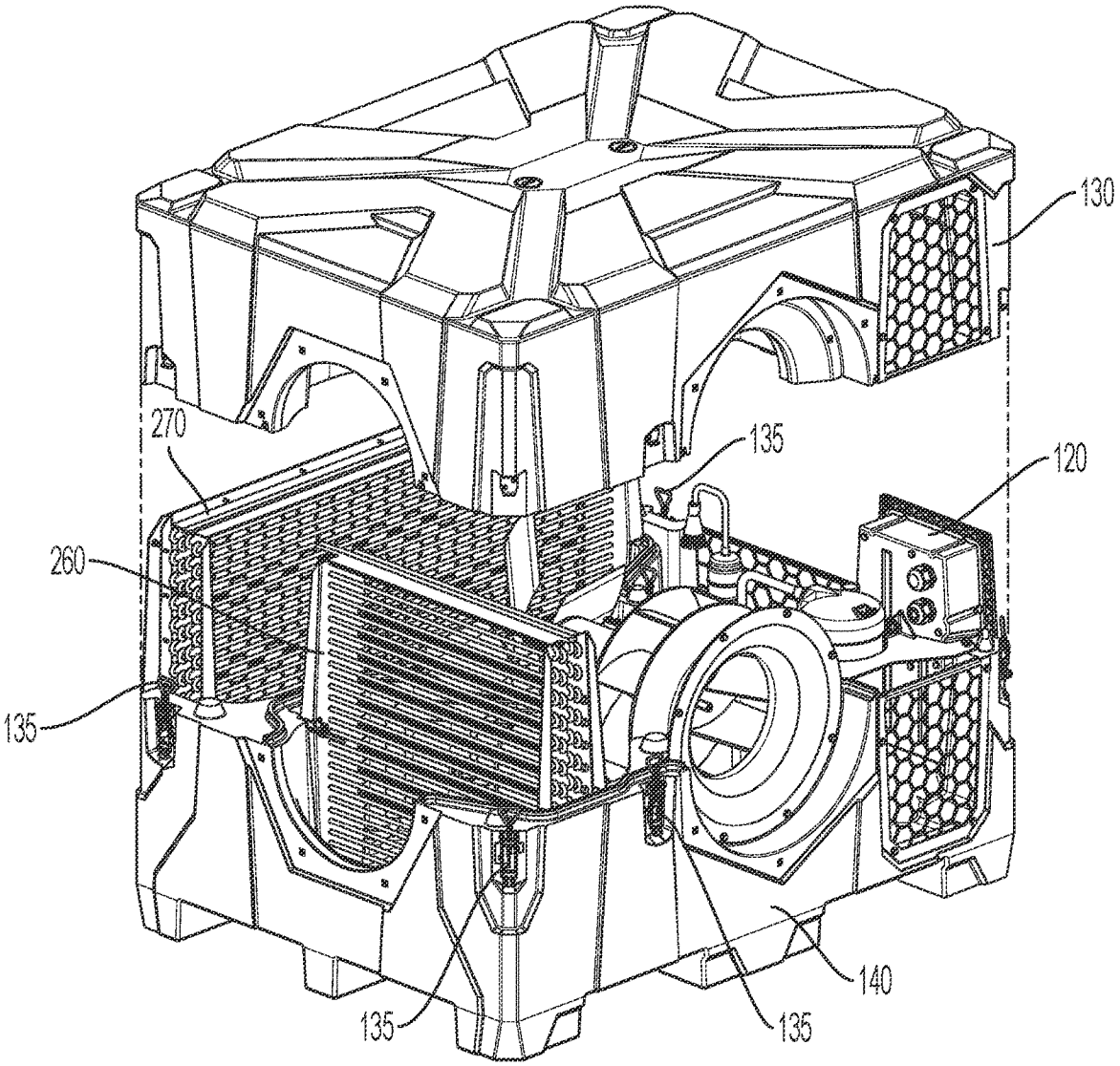
FIG. 6 shows an isometric view of one implementation of the RECU have the top structure released from the bottom structure.

FIG. 6 depicts one implementation of the RECU 10 where the top structure 130 is released from the base structure 140. Top structure 130 and base structure 140 are secured together by fasteners 135. These fasteners 135 can be latches.

Figure 6A:
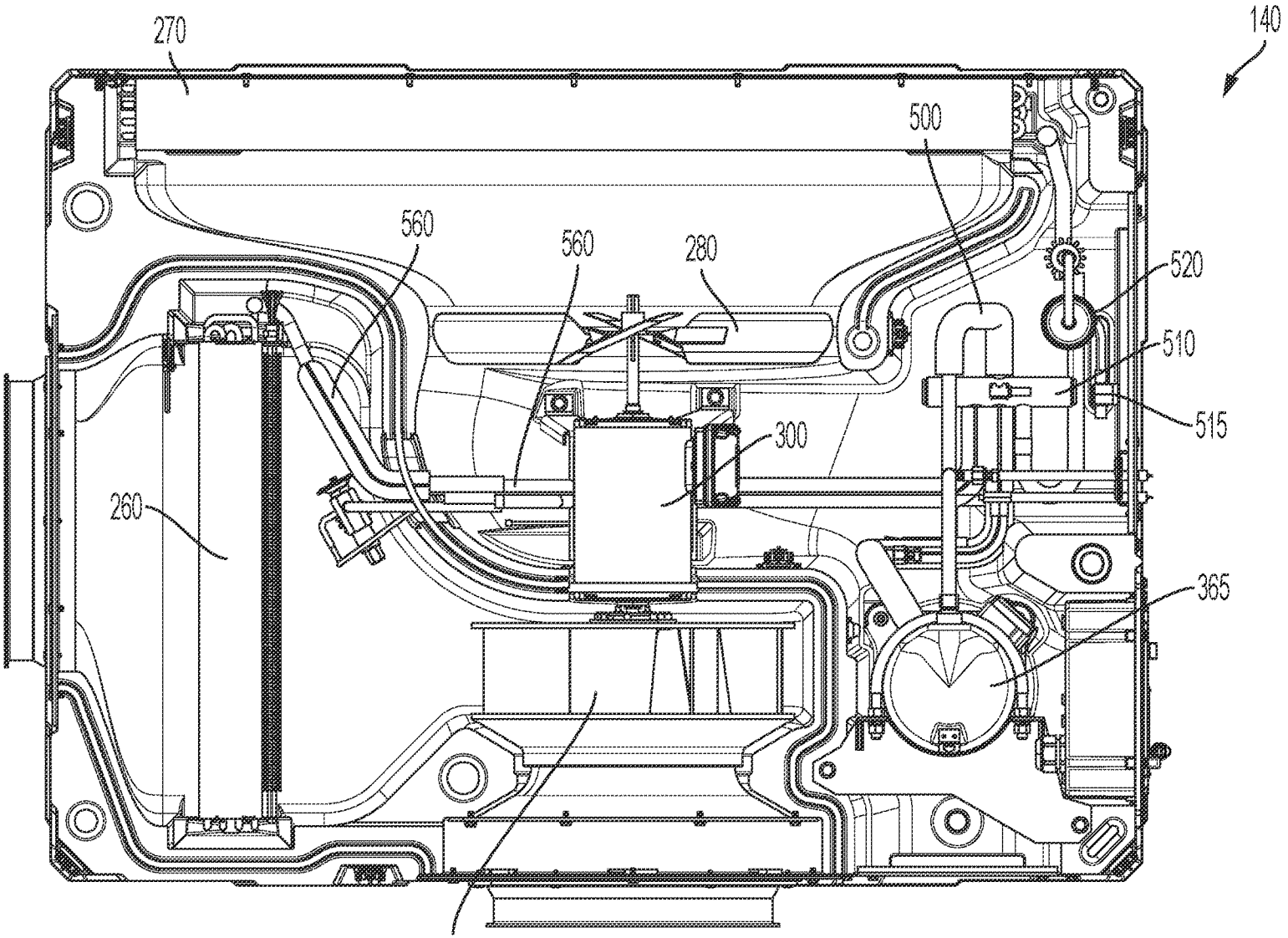
FIG. 6A shows a planar view of one implementation of the RECU's base structure with certain mechanical components installed therein.

FIGS. 6 and 6A depicts one implementation of the RECU 10 direct vapor compression mechanical component layout. Proximate the supply side 30 is an indoor coil 260. Proximate the outdoor side 20 is an outdoor coil 270. Proximate the outdoor coil is a fan 280 which can be, in one implementation, an axial fan. Proximate the return side 40 is a blower 290 which can be, in one implementation, a centrifugal fan. The control panel 120 is mounted on the control panel side 50 of the RECU 10 and is the central location for the electrical components and wiring needed for the RECU 10 to operate. Proximate the center of the RECU 10 is located the dual shaft motor 300. Fan 280 and blower 290 are connected to the dual shaft motor 300. Also, proximate the return side is a compressor 305. The plumbing needed to connect the compressor 305 to the indoor coil 260, outdoor coil 270 is identified as plumbing 500 that contains a reversing valve 510 and TXV 520. In addition, a sight glass 515 present within the plumbing 500 is brazed together and where needed is provided with insulation.

Figure 7:
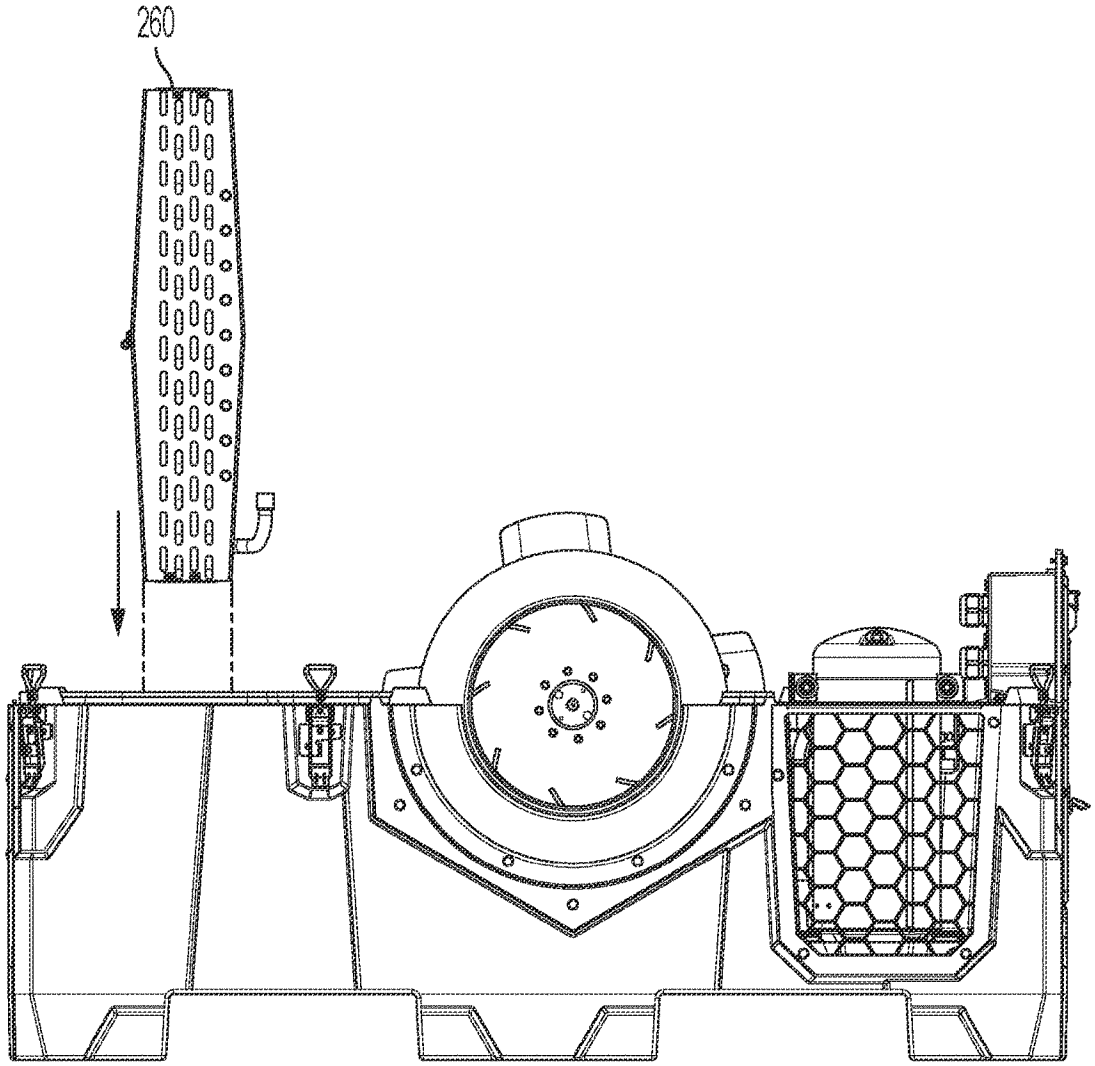
FIG. 7 shows an elevation view of one implementation of the RECU with the indoor coil released from the base structure.

As shown in FIG. 7, in one implementation of the indoor coil 260, the sides of the coil are shaped in a slightly wedged or tapered shape. This shape is mirrored on the RECU 10, see FIG. 8. The advantage of this shape is that the indoor coil 260 slides into place and does not need any extra fasteners to secure it to the RECU, the tapered edge provides sufficient securement for the indoor coil 260.

Figure 8:
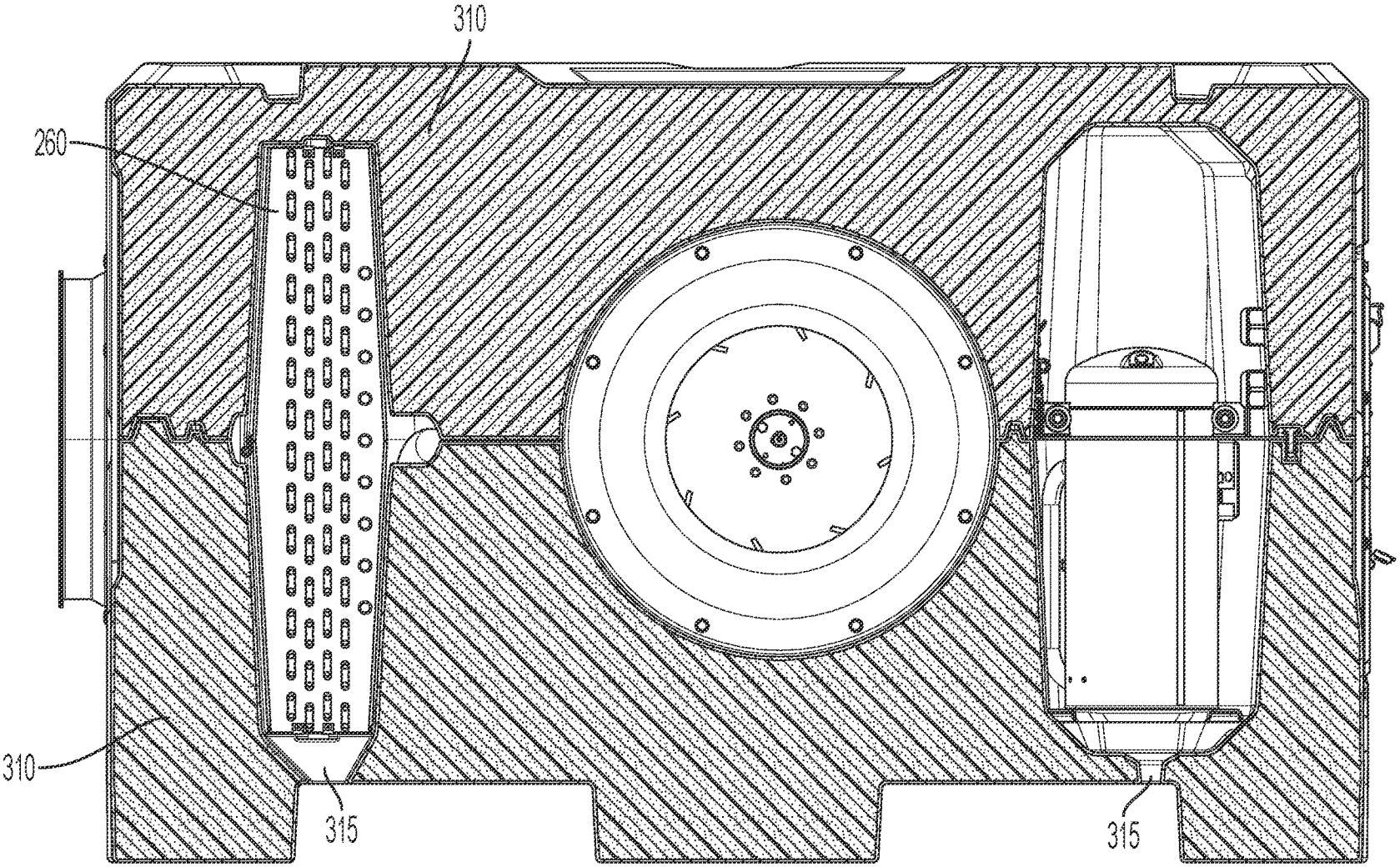
FIG. 8 shows a cutaway view of one implementation of the RECU's top and base structures.

As shown in FIG. 8, in one implementation, the interior cavities of the top structure 130 and base structure 140 can be filled with a closed-cell or open-cell foam material 310. In one implementation only the base structure can be filled with a closed-cell or open-cell foam material 310. To introduce the foam material 310 into the base structure, the alignment protrusions 220 are drilled out to permit access to the interior cavity and the foam material is inserted therethrough. In one implementation, drainage 315 is located within the base structure 140 to permit any condensate from pooling in the base structure 140.

As shown in FIG. 8, in one implementation, both the top structure 130 and base structure 140 are contoured to accommodate the slightly wedged or tapered side profile of the indoor coil 260.

Figure 9:
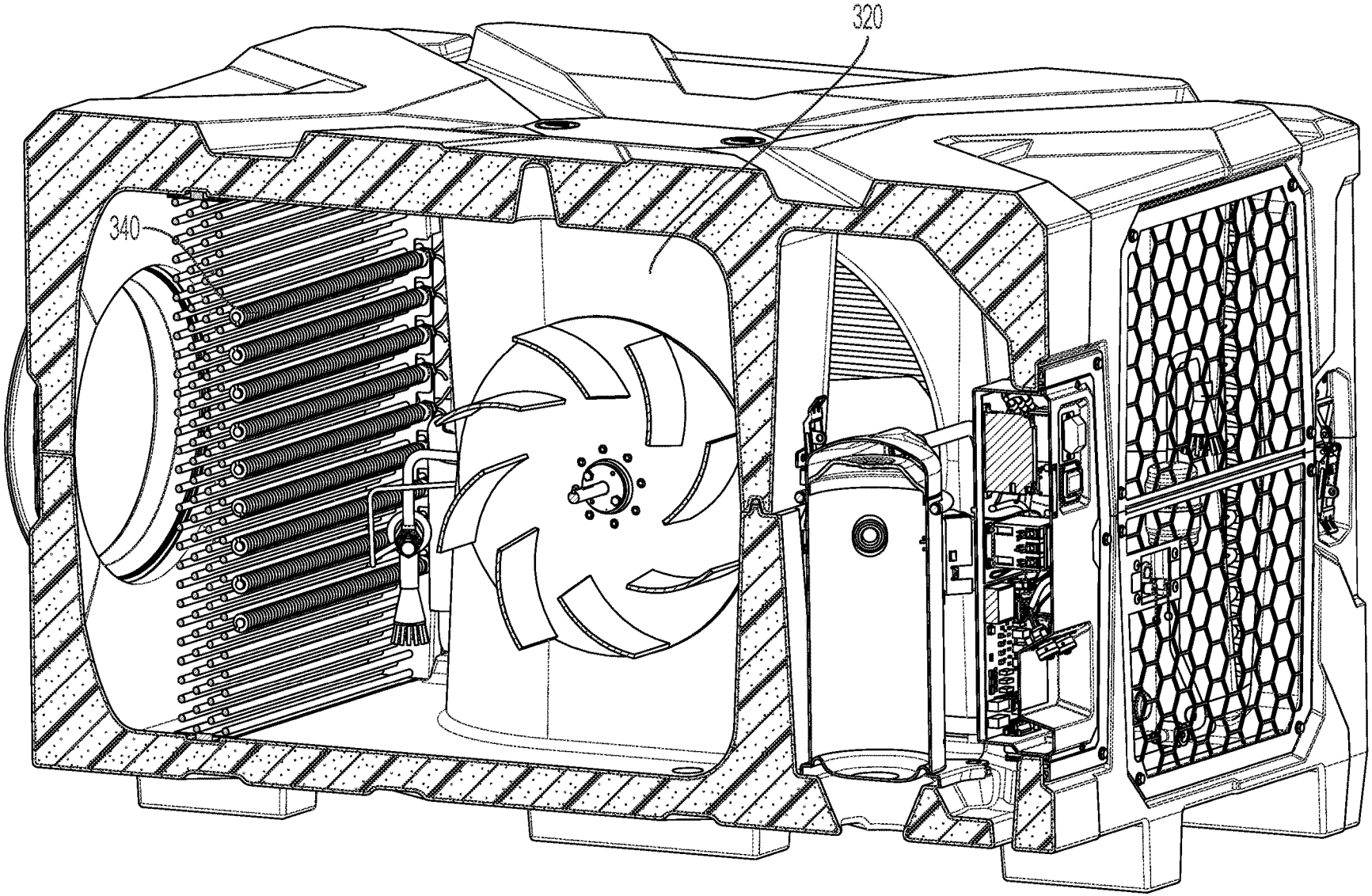
FIG. 9 shows an isometric cutaway view of one implementation of the RECU's plenum.
Figure 10:
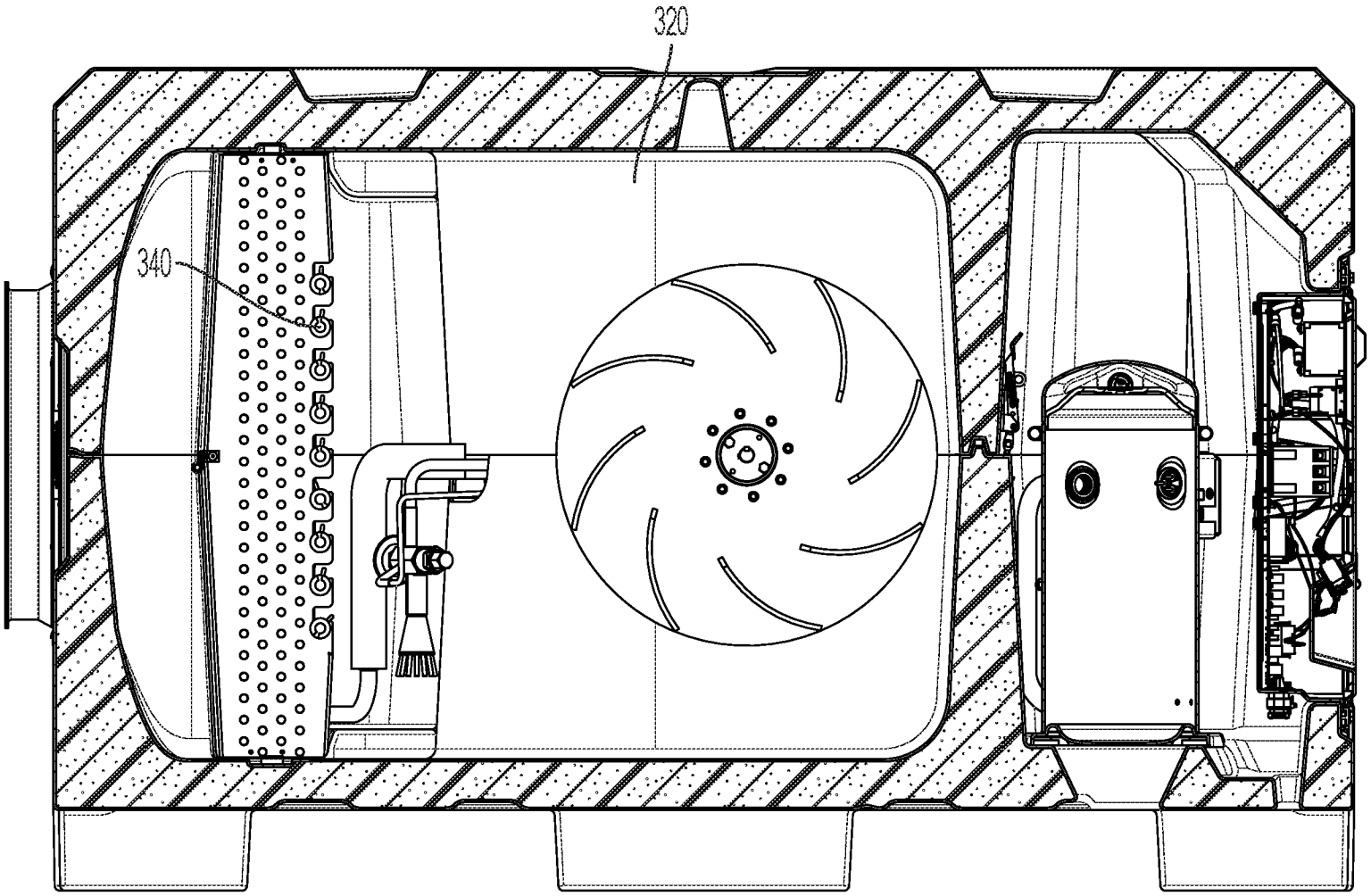
FIG. 10 shows a cutaway view of one implementation of the RECU's top and base structures to show a plenum implementation.
Figure 11:
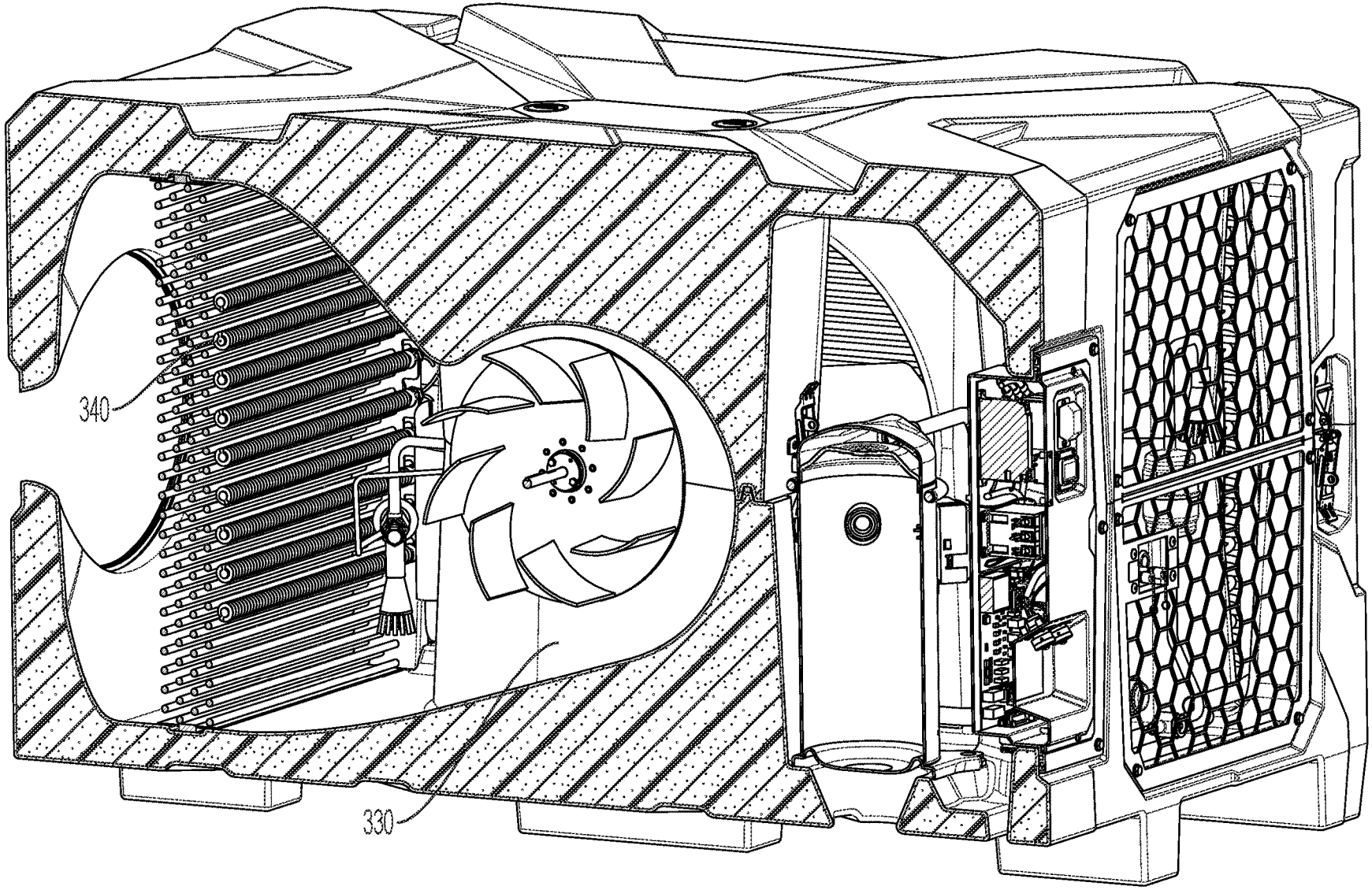
FIG. 11 shows an isometric cutaway view of one implementation of the RECU's integrated blower volute.
Figure 12:
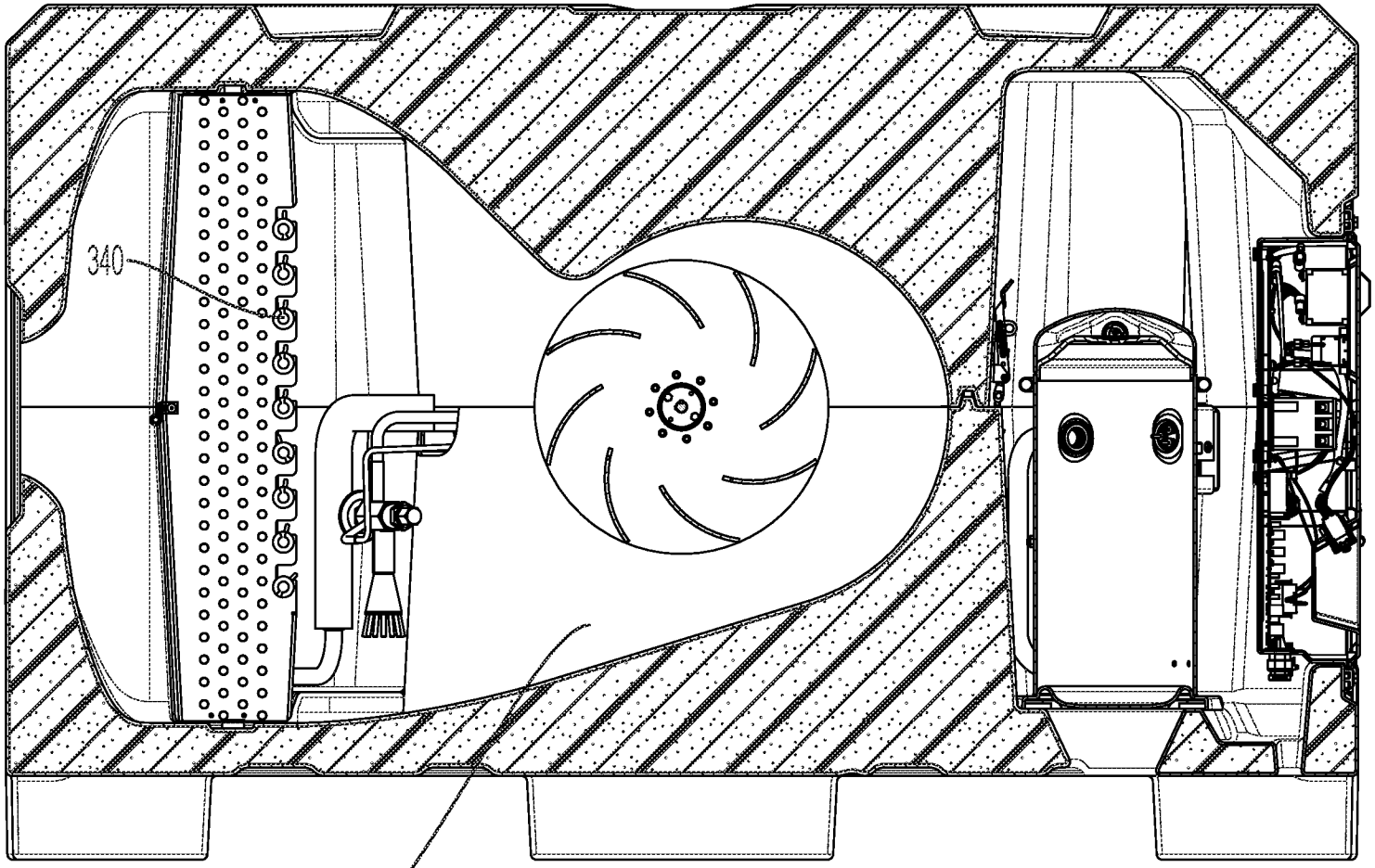
FIG. 12 shows a cutaway view of one implementation of the RECU's top and base structures to show a volute implementation.

As shown in FIGS. 9 and 10, in one implementation, the RECU 10 has a plenum formed as an open or boxed shaped plenum 320. FIGS. 11 and 12 illustrate an implementation of the RECU 10 where the cavity creates a volute 330 for the blower 290. FIGS. 9 and 11 also illustrate an implementation of the RECU 10 that includes electric heater coils 340 proximate the indoor coil 260. Electric heater coils 340 are used to provide additional heat when the RECU 10 is in heating mode.

Figure 13:
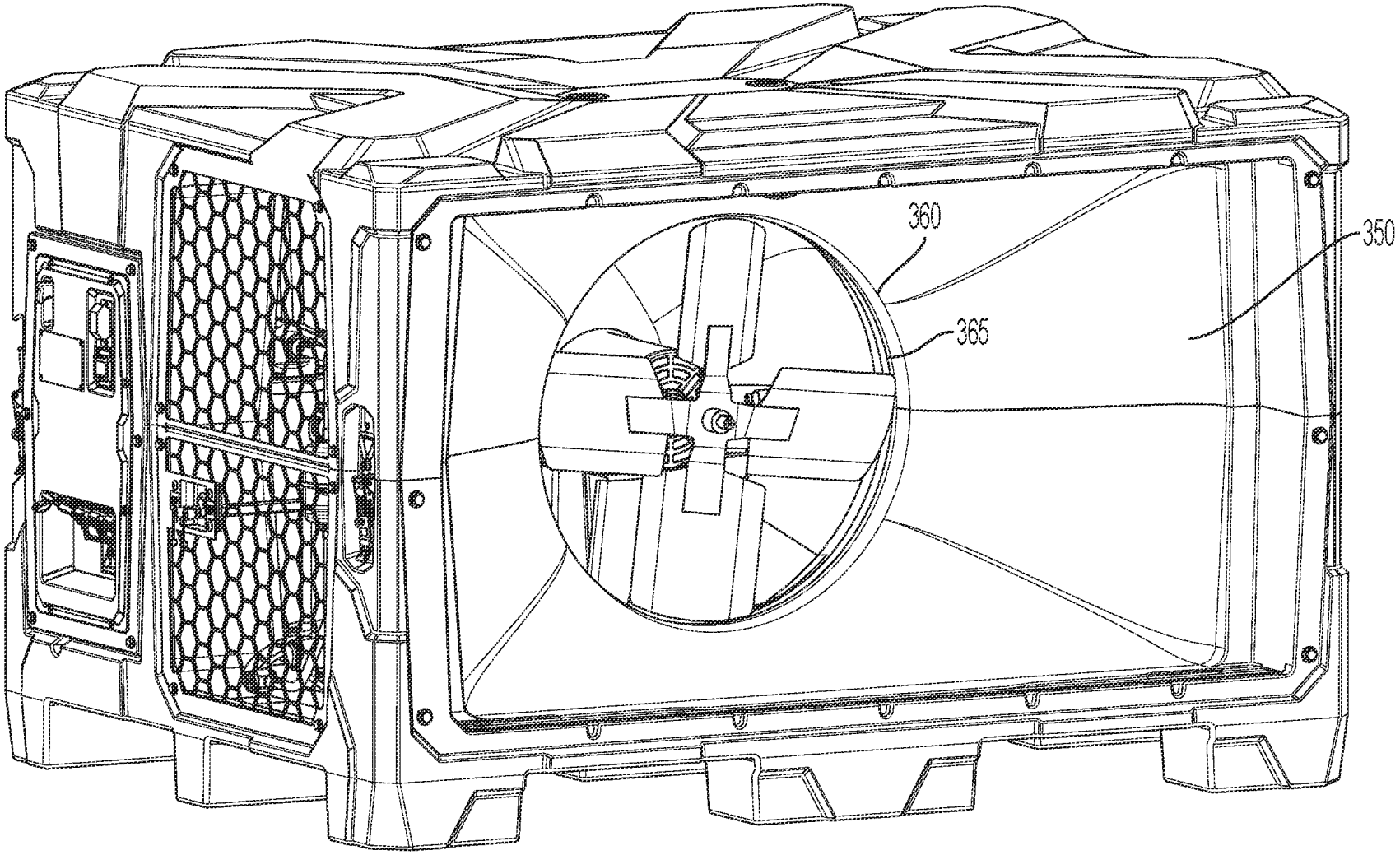
FIG. 13 shows an isometric view of one implementation of the RECU.

As shown in FIG. 13, in one implementation, an outdoor coil plenum 350 directs the airflow into the fan shroud 360 that fan 280 is positioned therein. The fan shroud 360 is, in one implementation, integrated into base structure 130 and top structure 140 as a fan shroud ring or sleeve 365 rather than having a separate shroud component. The integration of the fan shroud 360 into the base and top structures reduces costs. However, a separate shroud component could be mounted into the location where the fan 280 would be positioned.

Figure 14:
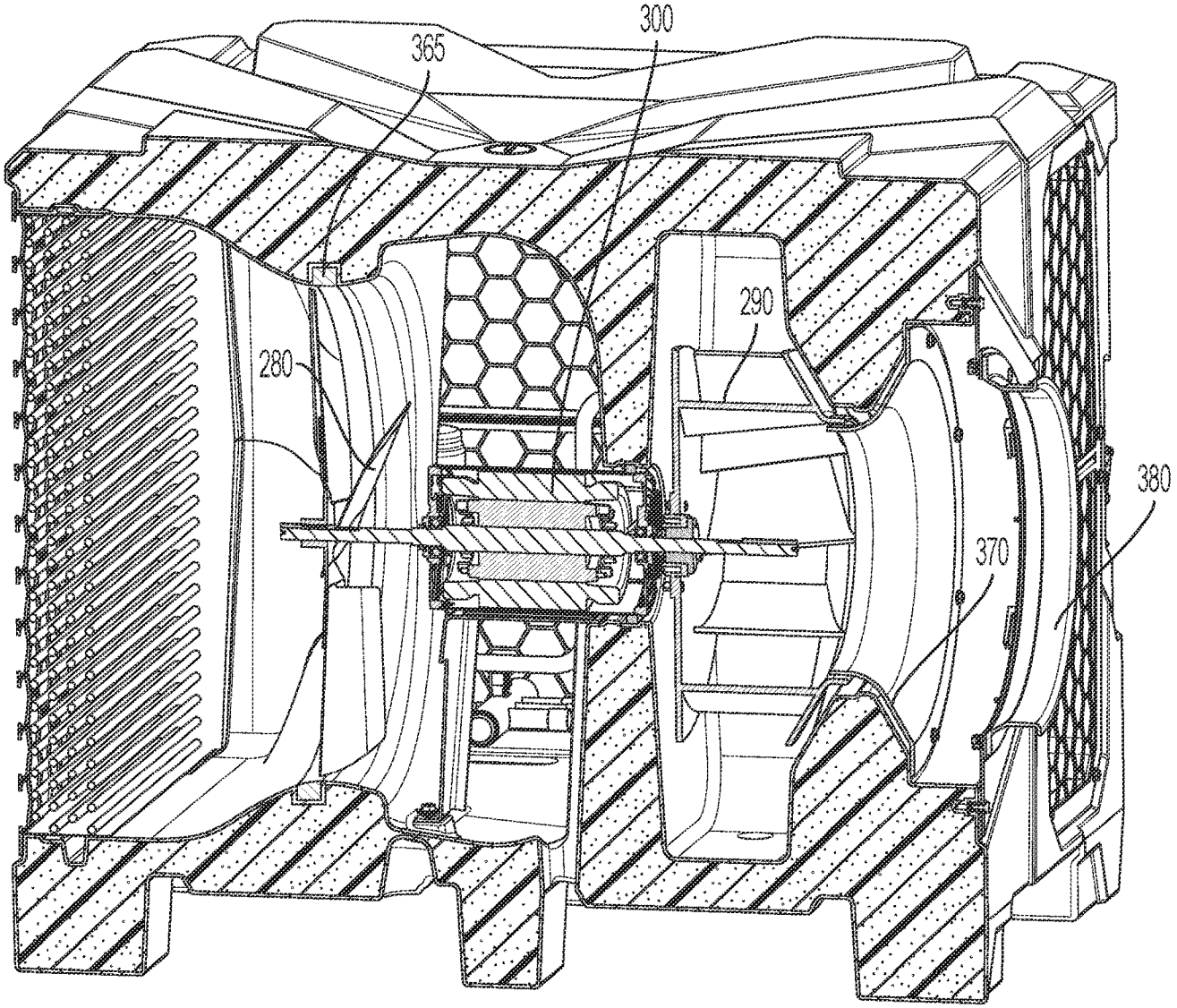
FIG. 14 shows a cutaway view of one implementation of the top and base structures of the RECU.

As shown in FIG. 14, in one implementation, the motor 300 that permits the fan 280 and blower fan 290 to operate is the dual shaft motor. The advantage of a dual shaft motor is that it eliminates the need for a second motor, thus reduces the cost of the RECU 10. As also shown in FIG. 14, fan shroud 360 is shaped to draw the air toward the fan 280. Ring or sleeve 365 is present to prevent any potential sagging due to increased loads being placed on the housing 10 such as from stacking another RECU on top of the housing 10. Proximate the blower fan 290 is a blower inlet ring 370 with a duct adapter mounting 380.

Figure 15:
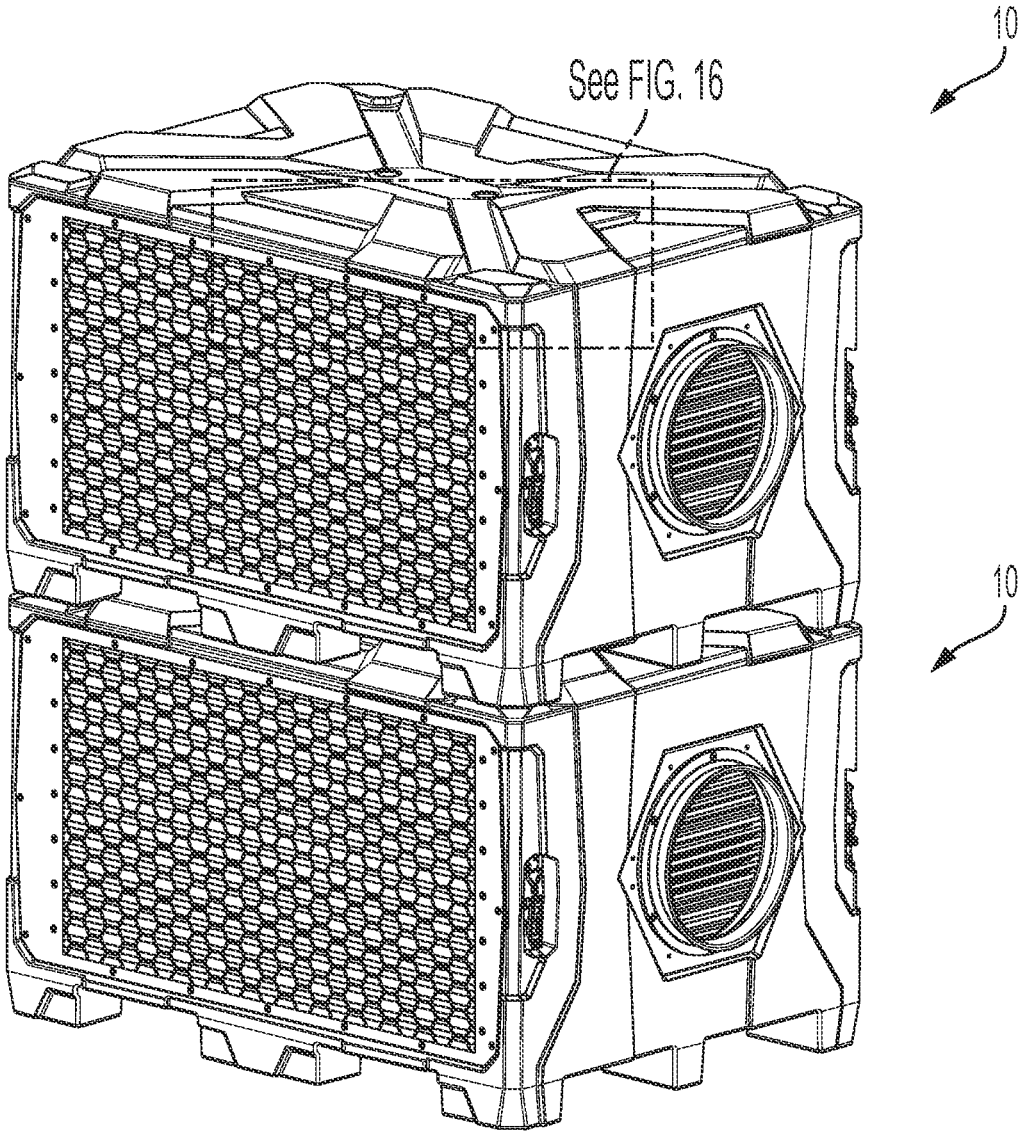
FIG. 15 shows one implementation of placing at least two RECUs for storing and transport.
Figure 16:
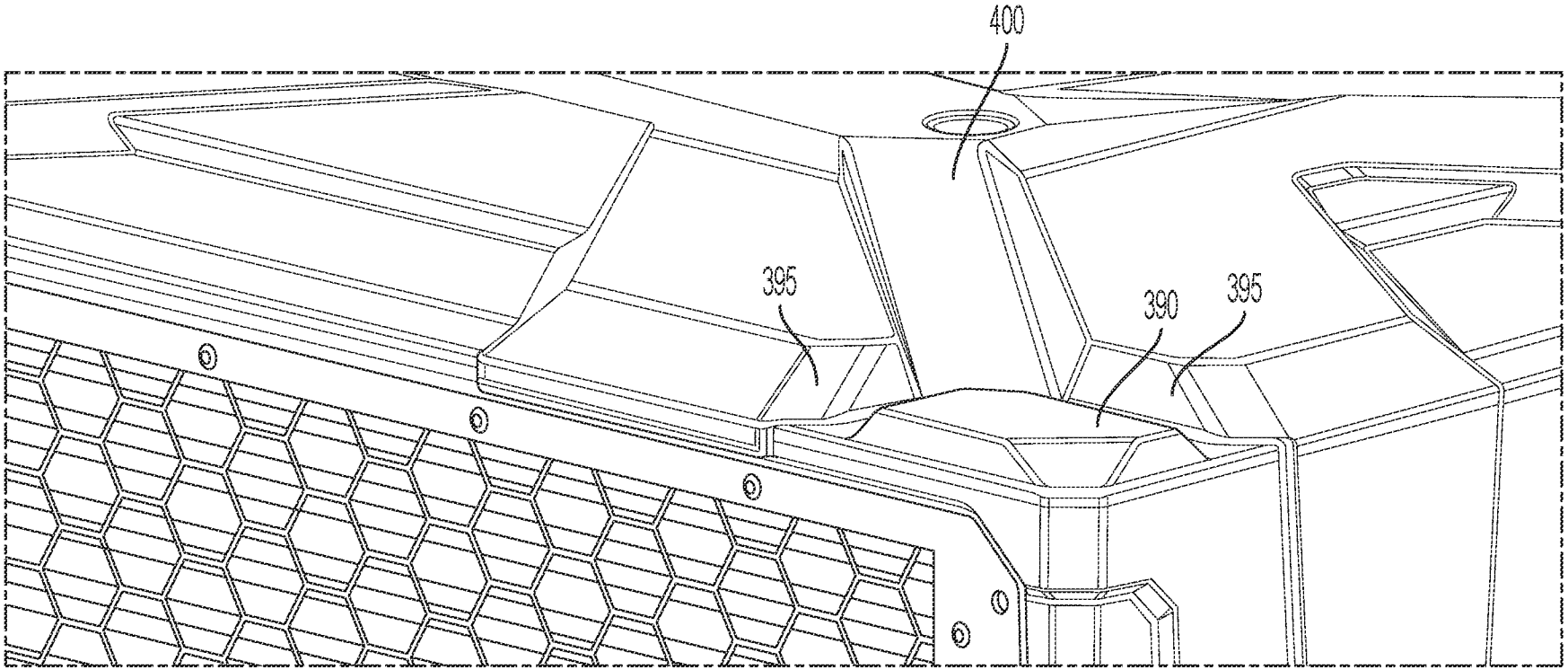
FIG. 16 shows one implementation of drainage and risers on the top surface of the RECU.

As shown in FIG. 15, in one implementation, RECU 10 is capable of being stacked on to another RECU 10 for transport and/or storage. As shown in FIG. 16, in one implementation, to assist in the stacking of the RECUs 10 for either storage or transport, risers 390 are strategically placed around the top side 70 of the top structure 130. In addition, in one implementation, drain channeling 400 is formed and is positioned to radiate and slope toward the edges of the top side 70 in order to any pooling of water on the top side because of environmental phenomena, such as weather.

Figure 17:
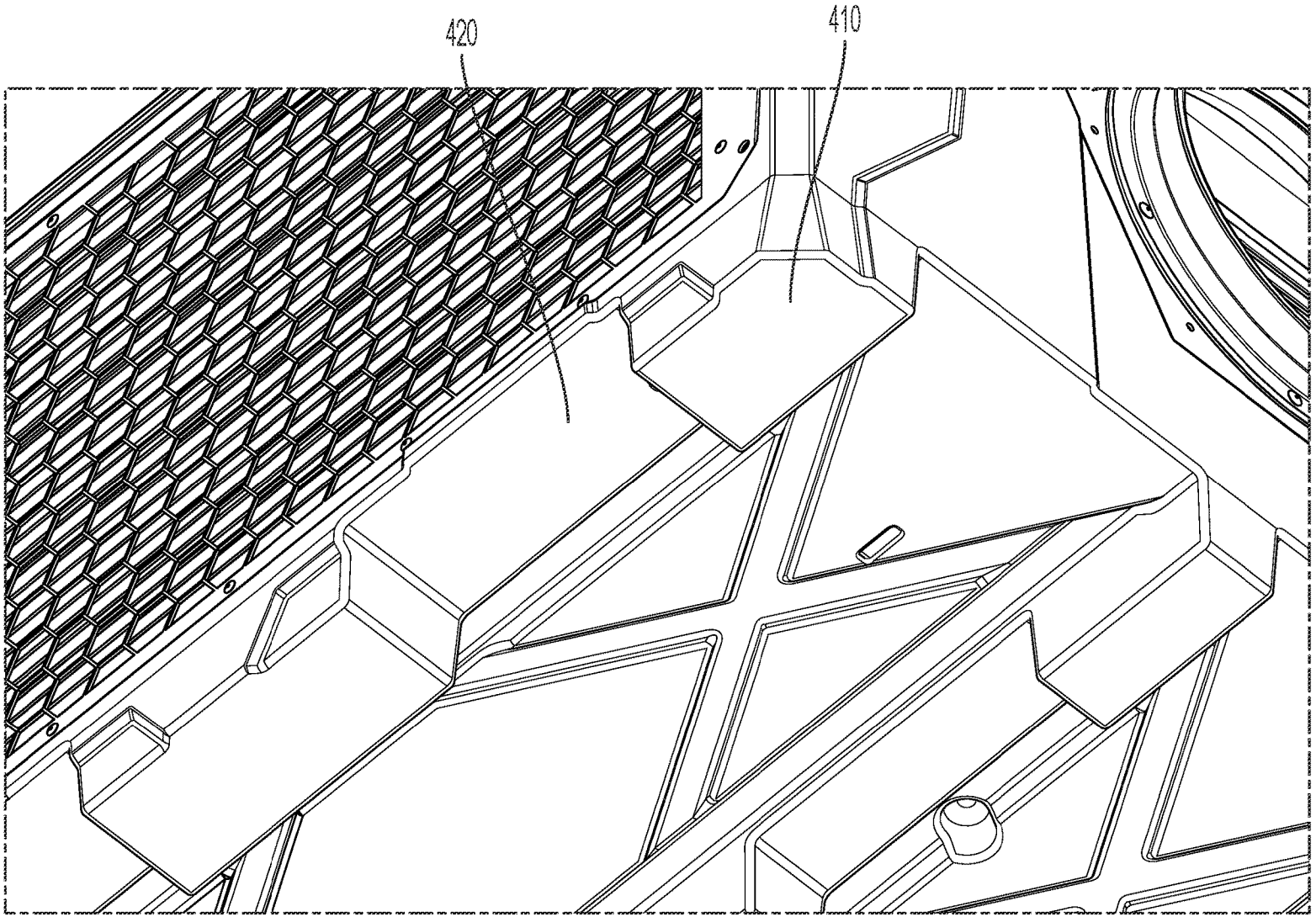
FIG. 17 shows one implementation of the bottom surface of the base structure of the RECU.

As shown in FIG. 17, in one implementation, a plurality of feet 410 and fork lift access points 420 are positioned on bottom side 60 of base structure 140. The feet 410 are positioned on the base structure 140 rest on the risers 390 positioned on the top side 70 of the top structure 130 to permit two or more RECUs to be stacked. See FIG. 15.

To prevent any stacked RECUs from sliding, the feet 410 interact with the features on the top structure 130. When the feet 410 rest on the risers 390 the side features 395 contact the feet 410. This contact prevents a foot 410 from moving in a plane parallel to the top surface 130 and effectively removing any translation motion.

As shown in FIG. 18, in one implementation, a RECU 10 is connected to a structure to provide environmental conditioning for the interior of the structure. The environmental conditioning could be cooling the air or warming the air to maintain a set temperature within the interior of the structure.

As an operational implementation of the RECU, the system is configured as an environmental control unit to provide cooling or heating via a vapor compression cycle. The vapor compression circuit is modulated by a reversing valve which allows the system to operate in either standard or heat pump mode. An additional 35,000 Btu/hr of supplement heat is provided by resistance heat strips. The operational temperature range is in cooling +50° F. to +125° F. while in heating −25° F. to +75° F. Operational altitude is from sea level to ten thousand feet. The output of the RECU will provide a minimum of 60,000 BTU/hr. of cooling at temperatures up to 125° F. at 90° F. dry bulb, 75° F. wet bulb, and 1 inch water gauge (wg) pressure. In addition, as an operational implementation of the RECU will output a minimum of 2,000 standard cubic feet per minute (SCFM) of indoor airflow at 1 in. wg. In one operational implementation of the RECU, the power required to start and operate the RECU in cooling mode at the maximum operational temperature of +125° F. will not exceed 11 kW.

In one operational implementation of the RECU, the manufacturers for the components are as follows. Copeland manufacturers the compressor having the model #ZR81KCE-TF5. Continental manufactures the indoor blower (centrifugal fan) having the model #TEK450. Revcor manufactures the outdoor axial fan having the model number G2204-24. WEG manufactures the dual shaft fan motor. Ningbo manufactures the TXV TCEN4.5-001 ⅝ in. by ⅞ in. Ningbo manufactures the reversing valve having the model number ZL-DSF-35-240 VAC. White Rodgers manufactures the sight glass AMI-1SS4. Ningbo manufactures the bi-directional filter drier SFK-164S. The indoor coil is manufactured by Modine and its fins are 12 FPI, 0.0075 in. in thickness and the distributor is 14 circuits with G-8 nozzle. The outdoor coil is manufactured by Modine and its fins are 10 FPI, 0.0095 in. in thickness and the distributor is 14 circuits with G-8 nozzle, 12 FPI can be used as well.

In one operational implementation of the RECU, the enclosure requirements require that four RECUs and all support components fit within an ISO Type 5 Tricon container. In one operational implementation, the RECU weighs no more than 650 lbs. The RECU is able to withstand a storage temperature within the range of −65° F. to +160° F. In one operational implementation, 14.5 in. by 3.75 in forklift pockets should be on all four sides of the bottom section. The RECU is able to be stacked and secured for storage. The RECU is able to withstand long term solar ultraviolet (UV) radiation exposure without any degradation, structural damage, or permanent deformation. The capability to drain condensate away from the components operating on sloped surfaces of up to 10 degrees and the RECU does not accumulate water or malfunction in blowing rain. In an operational implementation of the RECU, the external components are recessed so as not to extend beyond the exterior profile. In an operational implementation of the RECU, the ductwork adapters are 16 in. in diameter and capable of nuclear, biological, chemical (NBC) attachment.

In one implementation of the RECU, the bottom section or base structure has additional cores to connect the interior and exterior shells, kiss-off to prevent sagging or deformation under load, and modified/added beam structures to provide extra rigidity.

In one implementation of the RECU, the top section or top structure has kiss-offs to prevent sagging/deformation under load, added beam structure/ribbing for rigidity, and a sloped roof line for bowing prevention and water drainage. In an implementation, the slope is 0.75 in grade change from center to corners.

In one implementation of the RECU, the blower cavity is shaped as an open plenum-style. In one implementation of the RECU, the radial tip clearance between the axial fan and the axial fan shroud is within the range of 0.165 in. to 0.350 in., nominally 0.300 in.

In one implementation of the RECU, the interface geometry between the base structure and top lid structure is a full tongue and groove interface on the indoor side with additional alignment features, for example added protrusions above the sealing geometry to help pilot the top lid structure into place. In one implementation of the RECU, a sealant material is placed between the tongue and groove interface. In one implementation of the RECU, the sealant material is a neoprene foam cord; however, an adhesive-backed sealing material can be used as well.

In one implementation of the RECU 10 there is a curvilinear partition or bulkhead that separates the indoor plenum side and the outdoor air intake side. This partition has a recess that accepts a compression molded custom rubber gasket that is sized to permit the direct vapor compression plumbing, as well as heater and sensor wires, to pass through the bulkhead unimpeded. The gasket can be made out of any material commonly used for gaskets.

While we have shown and described several implementations in accordance with this disclosure, it should be understood that the same is susceptible to further changes and modifications without departing from the scope of this disclosure. Therefore, we do not want to be limited to the details shown and described herein but intend to cover all such changes and modifications as are encompassed by the scope of the appended claims.

What is claimed is:

1. A housing for an environmental control unit, comprising:

a rotomolded hollow base structure having a base bottom side, a base outdoor coil side extending from the base bottom side, a base control panel side extending from the base bottom side, wherein the base outdoor coil side is adjacent to the base control panel side, a base return side extending from the base bottom side and opposite from the base outdoor coil side and adjacent the base control panel side, a base supply side extending from the base bottom side and opposite from the base control panel side and adjacent the base return side and the base outdoor coil side, and a base partition extending from the base bottom side and ending in a first-half of a joint and spanning between the base return side and base supply side, wherein the base outdoor coil side is configured to receive outdoor environmental air and the base control panel side is configured to exhaust the outdoor environmental air so that outdoor air flows through the environment control unit and wherein the base return side is configured to receive indoor environmental air and the base supply side is configured to exhaust the indoor environment air so that indoor air flows through the environmental control unit; and a rotomolded hollow top structure having a top side, a top outdoor coil side extending from the top side, a top control panel side extending from the top side, wherein the top outdoor coil side is adjacent to the top control panel side, a top return side extending from the top side and opposite from the top outdoor coil side and adjacent the top control panel side, a top supply side extending from the top side and opposite from the top control panel side and adjacent the top return side and the top outdoor coil side, and a top partition extending from the top side and ending in a second-half of the joint and spanning between the top return side and top supply side, wherein the top outdoor coil side is configured to receive the outdoor environment air and the top control panel is configured to exhaust the outdoor environmental air so that the outdoor air flows through the environment control unit and wherein the top return side is configured to receive the indoor environmental air and the top supply side is configured to exhaust the indoor environment air so that the indoor air flows through the environmental control unit.

2. The housing of claim 1, wherein when the top structure is placed on the base structure, the base partition and the top partition mate together at the joint and separate the housing into an indoor air chamber between a return side formed from the base return side and top return side coming together and a supply side formed from the base supply side and the top supply side coming together and an outdoor air chamber between an outdoor coil side formed from the base outdoor coil side and the top outdoor coil side coming together and a control panel side formed from the base control panel side and the top control panel side coming together.

3. The housing of claim 2, wherein the indoor air chamber is a boxed shaped plenum.

4. The housing of claim 2, wherein the indoor air chamber forms a blower volute.

5. The housing of claim 2, further comprising:

a second base partition extending from the base bottom side and ending in a first-half of a second joint and starting proximate the base outdoor side and extending into the interior of the outdoor air chamber; and a second top partition extending from the top side and ending in a second-half of a second joint and starting proximate the top outdoor side and extending into the interior of the outdoor air chamber.

6. The housing of claim 5, wherein, when the top structure is placed on the base structure, the second base partition and the second top partition join together at the second joint and form an outdoor coil plenum with a section of the base partition and a section of the top partition and a fan shroud between the section of the base partition and the section of the top partition and the second base partition and the second top partition.

7. The housing of claim 1, further comprising:

at least one first projection extending from the base bottom side of the base structure and located proximate the base partition.

8. The housing of claim 1, further comprising:

at least one second projection extending from the base bottom side of the base structure and located proximate the intersection of the base return side and the base control panel side.

9. The housing of claim 1, further comprising:

a base coil recess having a first base coil recess edge and a second base coil recess edge within the base return side and a base coil edge within the base partition and located opposite the first base coil recess edge.

10. The housing of claim 9, further comprising:

a top coil recess having a first top coil recess edge and a second top coil recess edge within the top return side and a top coil edge within the top partition and located opposite the first top coil recess edge.

11. The housing of claim 10, wherein the base coil recess and top coil recess are in alignment when the top structure is placed on the base structure.

12. The housing of claim 9, further comprising:

a condensate pan recess formed in the base bottom side and spanning between the base coil recess and the base coil edge and a condensate pan drain formed in the base bottom side and proximate the condensate pan recess.

13. The housing of claim 1, wherein the base structure has a plurality of alignment projections and the top structure has a plurality of alignment recesses for aligning the top structure onto the base structure.

14. The housing of claim 13, further comprising:

a plurality of fasteners to secure the top structure to the base structure.

15. The housing of claim 1, wherein the base structure and the top structure are filled with a foam material.

16. The housing of claim 1, wherein the base structure has a plurality of feet and a plurality of fork lift access points.

17. The housing of claim 16, wherein the top structure has a plurality of drain channels and a plurality of side features to mate with the plurality of feet.

* * * * *